US005150998A

United States Patent [19]

Murakami et al.

[11] Patent Number: 5,150,998

[45] Date of Patent: Sep. 29, 1992

[54] SHEET BINDER

[75] Inventors: Koichi Murakami, Yokohama; Kazuhiro Matsuo, Tokyo; Kenichi Iizumi, Ibaraki; Yoichi Tagawa, Ushiku, all of Japan

[73] Assignees: Canon Kabushiki Kaisha, Tokyo; Daiichi Seiki Kaisha Kabushiki Kaisha, Ibaraki, both of Japan

[21] Appl. No.: 817,960

[22] Filed: Jan. 8, 1992

[30] Foreign Application Priority Data

| | | | |
|---|---|---|---|
| Apr. 13, 1989 | [JP] | Japan | 1-094206 |
| May 8, 1989 | [JP] | Japan | 1-114534 |
| May 8, 1989 | [JP] | Japan | 1-114535 |
| May 8, 1989 | [JP] | Japan | 1-114536 |
| Jul. 19, 1989 | [JP] | Japan | 1-188290 |

[51] Int. Cl.[5] ..... B42C 13/00

[52] U.S. Cl. ..... 412/14; 412/12

[58] Field of Search ..... 412/11, 12, 14, 16, 412/40

[56] References Cited

U.S. PATENT DOCUMENTS

| | | |
|---|---|---|
| 3,793,660 | 2/1974 | Sims . |
| 4,320,547 | 3/1982 | Stolle et al. . |
| 4,607,993 | 8/1986 | Scharer . |
| 4,938,467 | 7/1990 | Honjo et al. . |
| 4,965,629 | 10/1990 | Hiroi et al. . |
| 4,974,828 | 12/1990 | Matsuo et al. . |
| 4,978,045 | 12/1990 | Murakami et al. . |

FOREIGN PATENT DOCUMENTS 920508 3/1963 United Kingdom .

*Primary Examiner*—Timothy V. Eley
*Assistant Examiner*—William Fridie, Jr.
*Attorney, Agent, or Firm*—Fitzpatrick, Cella, Harper & Scinto

[57] ABSTRACT

A sheet binding apparatus includes a support for supporting a set of sheets; a puncher for punching the sets of sheets on the support; binder for binding the sheets by penetrating a ring member through punched holes of the sheets punched by the puncher; a detector for detecting a size of the ring member supported on the binder; a changing device for changing a degree of opening of the ring member in accordance with a size of the ring member; a conveyer for conveying the set of sheets punched by the puncher to the ring member supported on the binder; a second support for supporting the binder for movement between an automatic mode position wherein the binder receives the set of sheets conveyed by the conveyer and a manual mode position wherein the set of sheets can be received without use of the conveyer; a second detector for detecting the manual mode position of the binder and for prohibiting conveyance of the sheets by the conveyer; ring controller for controlling the degree of opening of the ring member during the manual mode; wherein the ring controller opens the ring member to the degree of opening predetermined in accordance with the size of the ring member.

4 Claims, 23 Drawing Sheets

SHEET BINDER

This application is a continuation of application Ser. No. 07/506,793 filed Apr. 10, 1990, now abandoned.

FIELD OF THE INVENTION AND RELATED ART

The present invention relates to a sheet binder, more particularly to a ring type sheet binder wherein sheets are punched, and the punched sheets are automatically bound by a binding ring member.

In a conventional ring binder wherein punched sheet materials are bound by a binding ring made of plastic resin comprising a spine and a number of inwardly curved fingers, the sheet materials are punched by a punching means including dies and punches, and thereafter, the sheet materials are taken out of the punching means, and the punched sheet materials are bound at another place.

Since the punched sheet materials are taken out of the punching means, and they are bound at another position, the binding operation is time-consuming, and the expertise are required to bind the sheet materials with the ring member.

More particularly, the operator has to adjust the punch position so that the sheet materials are punched at the position corresponding to the size of the binding member, and also, the operator has to adjust the degree of opening of the binding member to make the binding operation easier.

Therefore, expertise is required for the stabilized operation. Otherwise, the operating time becomes longer with the high possibility of erroneous operation.

SUMMARY OF THE INVENTION

Accordingly, it is a principal object of the present invention to provide a sheet binder which is easy to manipulate.

It is another object object of the present invention to provide a sheet binder in which an automatic binding mode, a manual binding mode (including a re-binding mode), are selectable.

According to an aspect of the present invention, there is provided a sheet binder comprising punching means for punching sheet materials, conveying means for conveying the punched sheet materials, and binding means for binding the conveyed sheet materials, and further comprising re-binding operating means for operating said sheet binder without the punching operation by said punching means to allow the sheet materials to be re-bound by the binding means.

In this aspect, the re-binding operation is performed wherein the punching operation by said punching means is omitted, so that the sheet materials are prevented from being punched repeatedly with the possible result of enlarged punch holes. In addition, by operating the re-binding means, the re-binding operation can be carried out automatically, the saving the labor in the re-binding operation.

These and other objects, features and advantages of the present invention will become more apparent upon a consideration of the following description of the preferred embodiments of the present invention taken in with the accompanying drawings.

BRIEF DESCRIPTION OF THE DRAWINGS

FIG. 16(*b*) is a side view thereof when the ring is opened in the manual mode.

DESCRIPTION OF THE PREFERRED EMBODIMENTS

Preferred embodiments of the present invention will be described i conjunction with the accompanying drawings.

Figure 1:
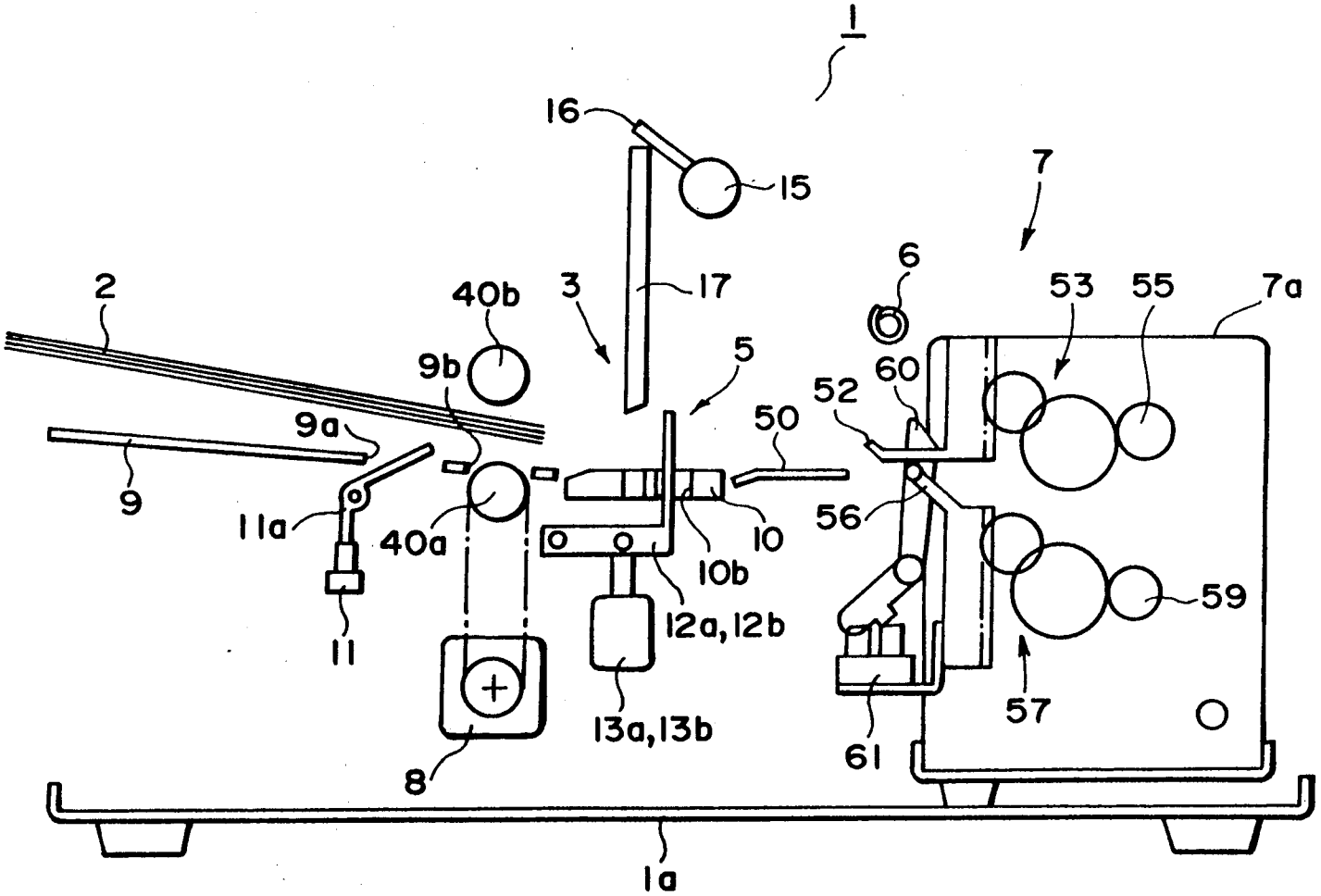
FIG. 1 is a sectional view of a binding apparatus according to an embodiment of the present invention.

Referring to FIG. 1, the sheet binding apparatus 1 according to the first embodiment comprises a punching station 3 for punching a set of sheet materials or sheets 2, a conveyer 5 for conveying the punched sheets 2 and a ring opening station 7 for opening and closing a binding ring 6 for binding the sheets 2 conveyed thereto. They are mounted on a bed 1*a* of the apparatus 1.

Figure 4:
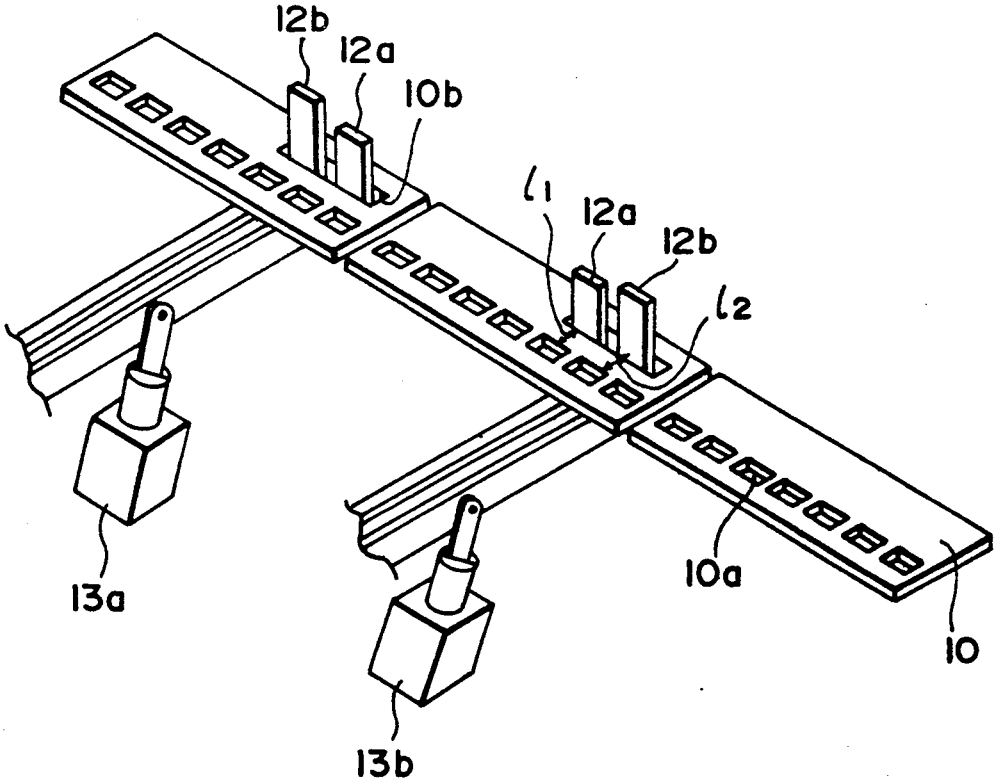
FIG. 4 is a perspective view of a die and a stopper.

Referring to FIGS. 1, 4, 5, 6, 7 and 8, the punching station 3 will be described. As shown in FIG. 1, a die 10 is disposed close to a sheet supporting tray 9. The supporting tray 9 is provided with a sensor hole 9*a* and a roller hole 9b. In the sensor hole 9a, a sensor lever 11a for detecting presence of the sheet material 2 is disposed. Below the sensor lever 11a a sensor 11 is disposed to detect the presence of the sheets 2 in response to the movement of the sensor lever 11a. As shown in FIG. 4, the die 9 has a number of square die holes 10a aligned in a line and two through holes 10b at a position downstream of the holes 10a with respect to the direction of the sheet conveyance which will be described hereinafter. Through the holes 10b, a pair of short stoppers 12a and a pair of long stoppers 12b for abutment with edges of the sheets 2 are retractable to align the sheets 2. The stoppers 12a constituting the pair are integrally connected, and also, the stoppers 12b constituting the pair are integrally connected. The stoppers 12a and 12b are coupled with solenoids 13a and 13b, respectively. The solenoids 13a and 13b lower the associated stoppers when it is deenergized, and raise them when it is energized. The distances $l_1$ and $l_2$ between the holes 12a and the stoppers 12a and 12b satisfy $l_1 < l_2$.

It is desirable that the sheet materials 2 are punched at proper position which changes depending on the size of the resin ring 6 used. When the resin ring 6 is set on the upper supporting member 52 at the binding station, the ring sensor lever 60 automatically operates to detect the size of the resin ring 6 by the ring sensors 61a and 61b. Then, in order to set the proper punching position for the sheet materials 2, the stoppers 12a and 12b are interrelatedly moved.

In this embodiment, two punching positions are prepared (the number may be three or more), and in response to the signal indicative that the resin ring 6 has been set, a selected one of the solenoids 13a and 13b is energized, by which non-selected one of the solenoids 13b and 13a is retracted. To the selected one, the sheet materials 2 are abutted. The number of the stoppers 12a and 12b' may be two or more. In addition, it or they may be movable.

Figure 5:
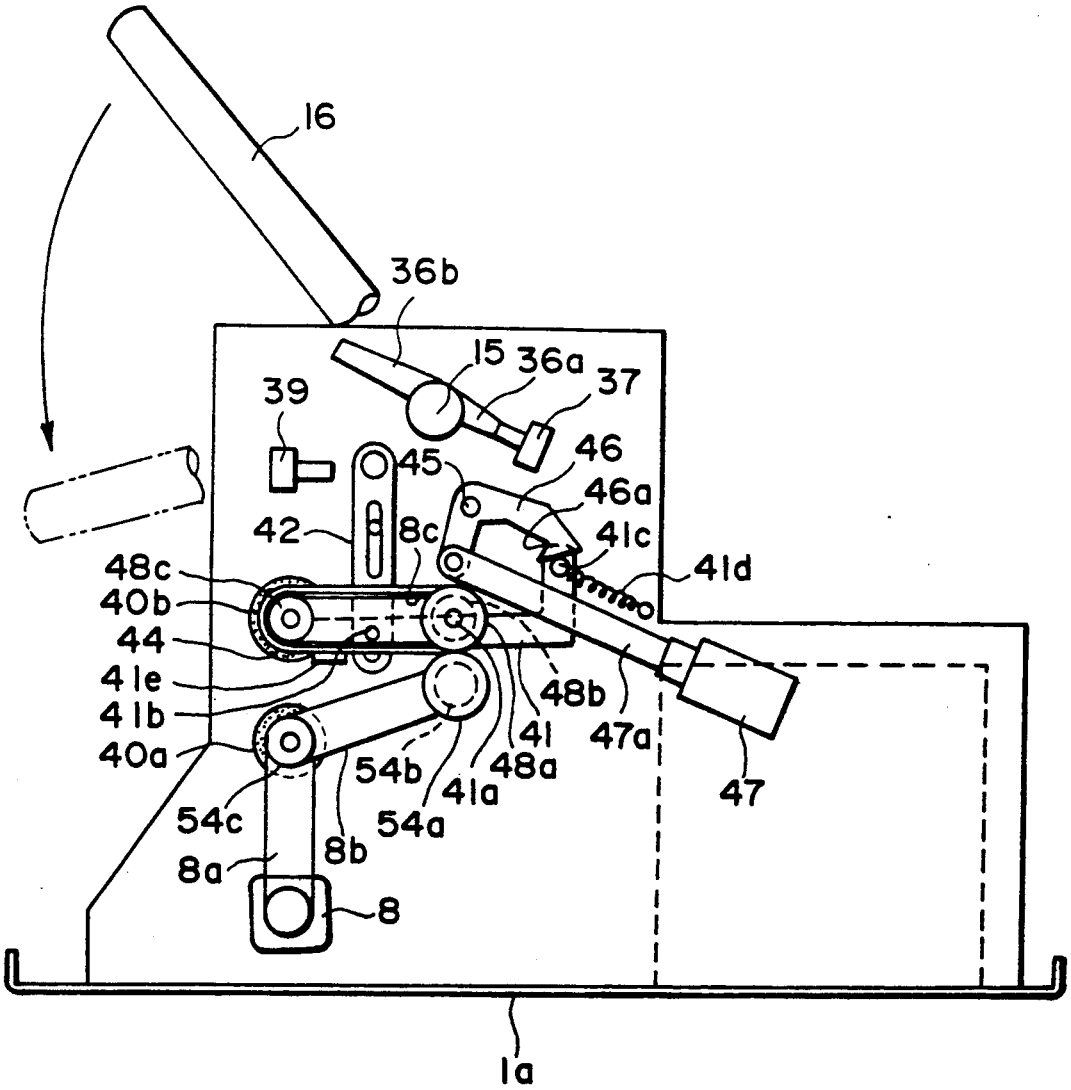
FIG. 5 is a side view of a punching station.
Figure 6:
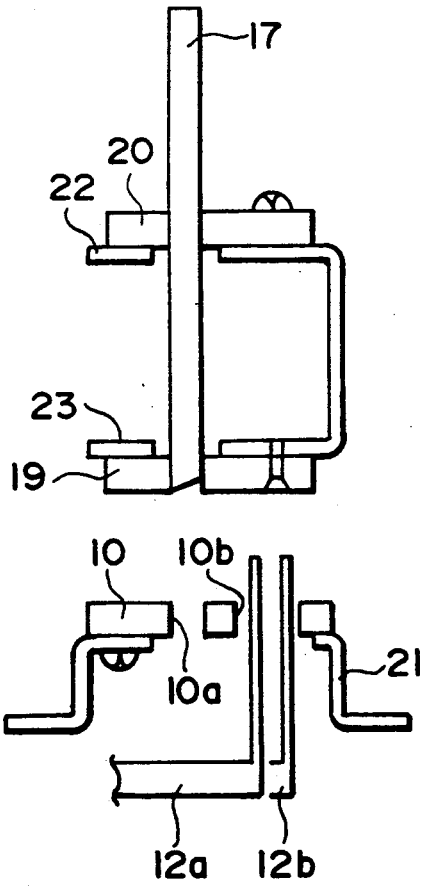
FIG. 6 is an enlarged side view illustrating a relation among the die, puncher and a stopper.

As shown in FIGS. 1, 5 and 6, an operating lever 16 has shaft 15. When it is rotated in the counterclockwise direction, the puncher 17 lowers along guides 19 and 20 to penetrate through the holes 10a of the die 10 which will be described hereinafter.

Figure 7:
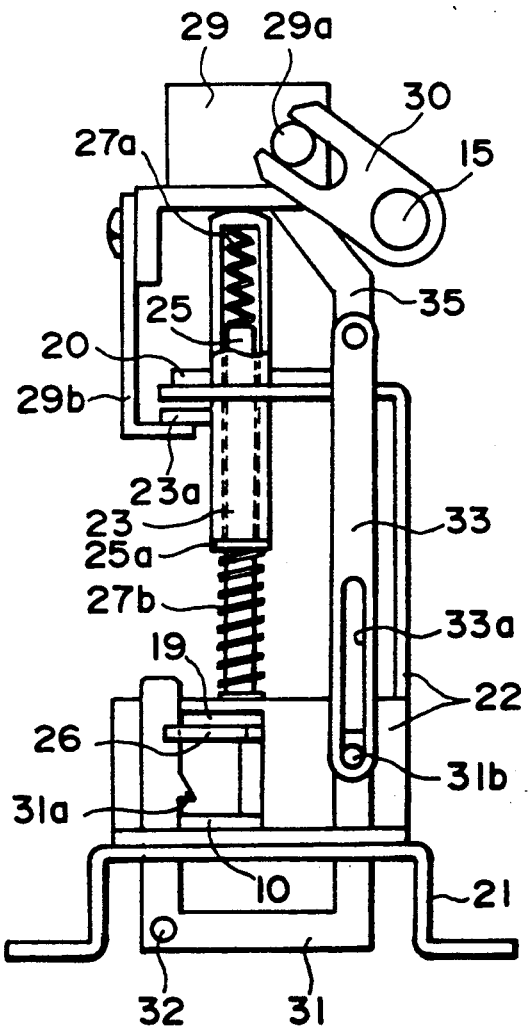
FIG. 7 is a side view of a sheet confining mechanism.
Figure 8:
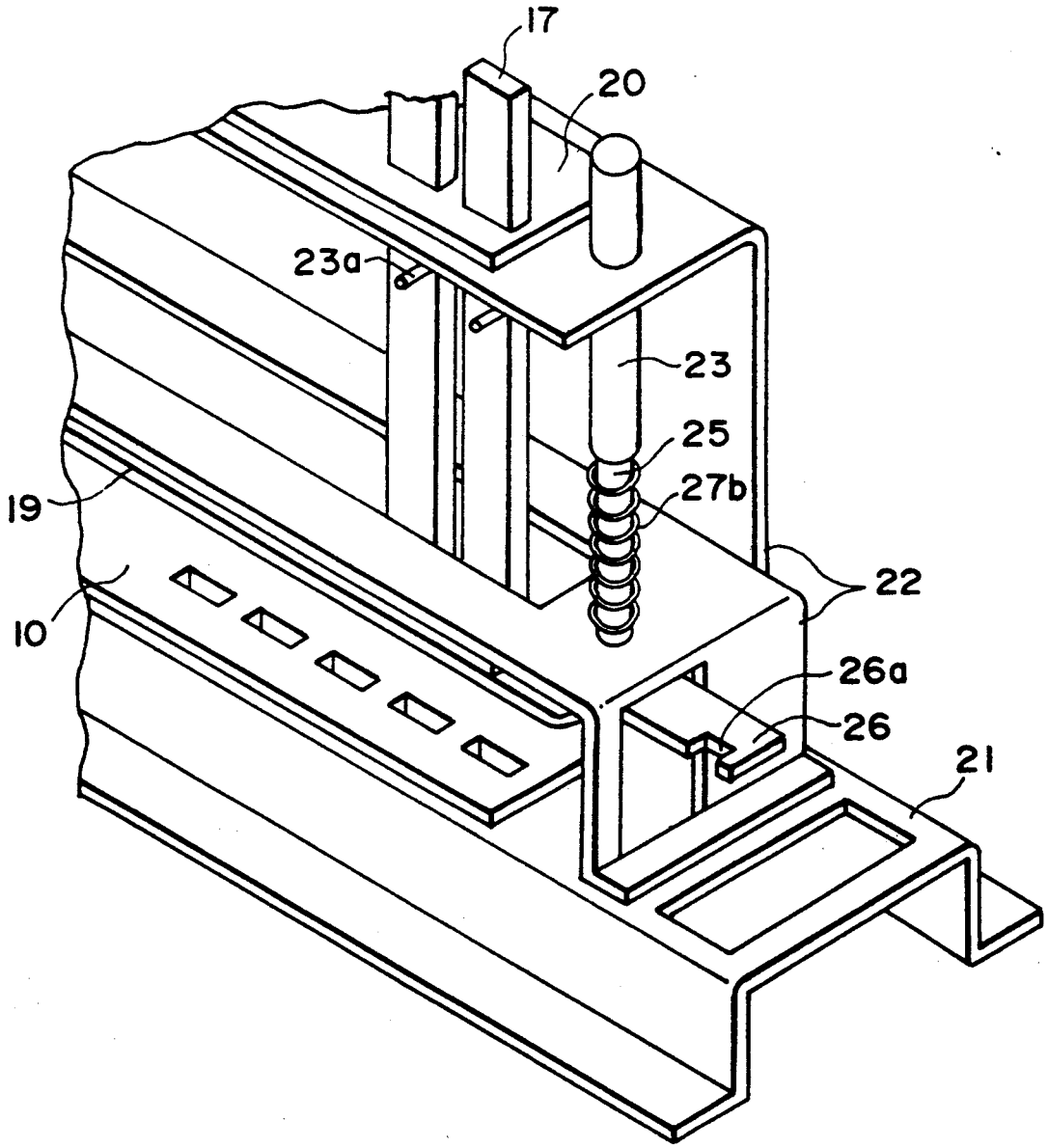
FIG. 8 is an enlarged perspective view of the sheet confining mechanism of FIG. 7.

As shown also in FIGS. 7 and 8, the die 10 is fixed on a die base 21. The guides 19 and 20 are fixedly mounted on a supporting frame 22 which is fixed to the die base 21. At upper portions adjacent longitudinally opposite ends of the supporting frame 22, there are sleeves 23, and punching rods 25 in telescope relation therewith. The bottom of the pushing rods 25 are fixedly mounted to a confining plate 25. Between each of the sleeves 23 and an upper end of the associated pushing rod 25, a compression spring 27a is mounted, and between a flange 25a of each of the pushing rods 25 and the supporting frame 22, a compression coil spring 27b is mounted around the pushing rod 25. A pressing arm 29 is mounted on the top end of the punches 17, and it pushes the sleeve 23 downwardly. The pressing arm 29 is provided at longitudinal end projections 29a which are engaged with lever arms 30, which in turn is fixedly mounted to the ends of the shaft 15. When the lever 16 (FIGS. 1 and 5) is rotated in the clockwise direction, the pressing arm 29 lowers. Each of the punches 17 has a projection 23a which abuts a limiter 29b mounted on the pressing arm 29. The confining plate 26 has a cut-away portion 26a with which a locking plate 31 which has a generally hook shape. The locking plate 31 has a pawl 31a in its vertical portion. The bottom of the vertical portion is rotatably supported on a pin 32, and another vertical portion of the locking plate 31 has adjacent its upper end a projection 31b which is engaged with an elongated slot 33a of a releasing link 33. An upper portion of the releasing link 33 is rotatably supported on an arm 35 downwardly extended from the pressing arm 29, so that the pressing arm 26 is confined or released by the pawl 31a of the locking plate 31.

As shown in FIG. 5, sensor levers 36a and 36b are rotatable together with the lever 16. An upper sensor 37 and a lower sensor 37 are faced to the sensor lever 36a when it is at its upper position, and faced to the sensor lever 36b when it is at its lower position, respectively.

Figure 9:
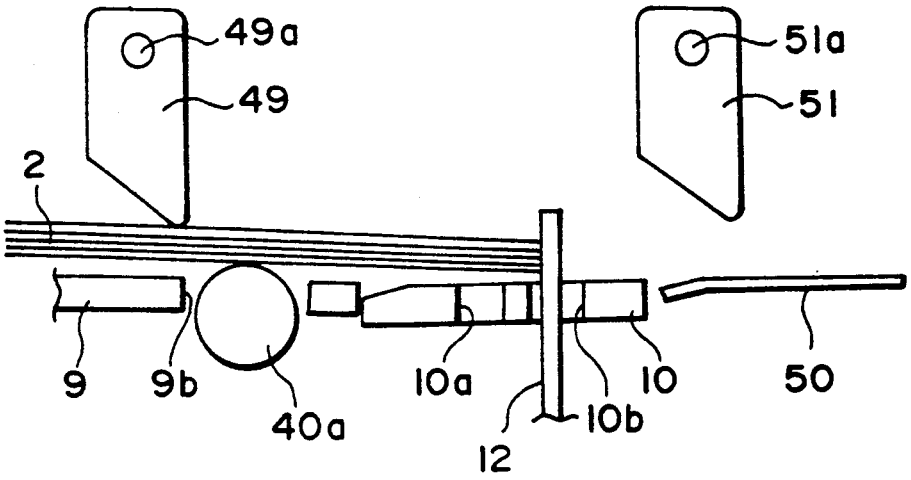
FIG. 9 is a side view of a conveyer.

Referring to FIGS. 1, 5 and 9, the conveyer 5 will be described. In this embodiment, the upper conveying roller 40b and the lower conveying roller 40a are disposed spaced apart from each other to provide a pick-up structure, as shown in FIG. 9. When the sheet materials 2 are inserted to be abutted to the stopper 12a or 12b, the upper conveying roller 40b is at a retracted position from the conveying passage. After the punching operation is completed, it is lowered into the conveying passage in order to convey the sheet materials 2 to the binding station.

The conveying roller 40a which is driven by a motor 8 mounted rotatably on the apparatus 1 is projected through the roller hole 9b of the sheet supporting tray 9. A pick-up lever 41 is rotatably supported on a pin 41a fixedly mounted on the apparatus at its intermediate position. A lower end portion of the pick-up arm 42 is rotatably mounted on the lever 41 by a pin 41b at a left side of the pin 41a. A right end of a lever 44 is rotatably supported on the lever 41. To the left end of the lever 44, an upper conveying roller 40b is rotatably supported. On the right end of the lever 44, a gear 48a and a pulley 48b coaxially integral with the gear 48a are rotatably supported. A pulley 54b is coaxially integral with a gear 54a which is in meshing engagement with the gear 48a. A pulley 54c is coaxial with and integral with the lower conveying roller 41a. A pulley 48c is coaxial and integral with the upper conveying roller 41b. Belts 8a, 8b and 8c are trained around a pulley of the motor 8 and the pulley 54c, around the pulley 54c and the pulley 54b, around the pulley 48b and the pulley 48c, respectively. By the rotation of the motor 8 in the clockwise direction, the upper and lower conveying rollers 40a and 40b grip the sheet materials 2 and convey them rightwardly. A tension spring 41d is mounted to the lever 41, so that the lever 41 is normally urged in the clockwise direction about the pin 41a, and that the arm 42 is normally urged upwardly through the pin 41b. A vertical portion of the lever 41 is provided with a projection 41c, which is engageable with an engaging portion 46a of a hook 46 rotatably supported on a pin 45 fixed on the apparatus. The other end of the hook 46 is rotatably supported at an end of a core rod 47a of a solenoid 47. When the solenoid 47 is energized, the hook 46 rotates in the clockwise direction, by which the projection 41c is locked at its right side. When the solenoid 47 is deenergized, the hook 46 rotates in the counterclockwise direction to be released from the projection 41c. When the lever 16 is operated to rotate the sensor lever 36b in the counterclockwise direction to such an extent that the lower limit sensor 49 is interrupted, and when the arm 42 is lowered simultaneously against the upward urging force, the left side of the lever 41 is lowered, so that the lever 44 is released from the locking portion 41*e* of the lever 41, and the upper conveying roller 40*b* lowers by its weight together with the lever 44 to be press-contacted to the lower conveying roller 40*a*.

An inlet guide 49 (FIG. 9) for limiting the thickness of the set of sheet materials is rotatably supported on a pin 49*a* fixed on the apparatus to be rotatable in the clockwise direction. The counterclockwise rotation is stopped by the stopper 49*b*. A conveying tray 50 (FIG. 9) is closely downstream of the die 10. A ring inlet guide 51 is effective to prevent disturbance of leading edges of the sheet materials coming thereto. The guide 51 is rotatably supported on a pin 51*a* fixedly mounted on the apparatus.

Referring to FIG. 1, 10, 11, 12, 13 and 14, the ring opener 7 will be described. Upper pawls 52 are extended in a horizontal plane in the form of comb, and they have inclinedly bent up ends. The upper pawls 52 are vertically guided by the insides of the side walls of the main assembly 7*a* of the ring opener. The upper pawls 52 are driven by a motor 55 through a gear train 53. A number of lower pawls 56 are projected up inclinedly, and they have end portions extending perpendicularly to the conveyance direction of the sheet materials 2. The lower pawls 56 are driven by a motor 59 through a gear train 57. A ring 6 which is a binding member having one spine and a number of lateral fingers bent into substantial circles are set on the upper pawls 52 at its fingers. The sensor lever 60 rotatably mounted on a shaft 60*a* and normally urged in the clockwise direction, is rotated in the counterclockwise direction by the distance corresponding to an outside diameter of the ring 6. Below the sensor lever 60, a plurality of ring sensors 61 are disposed along a line to detect the presence of the ring 6 and the size of the ring 6.

Figure 13:
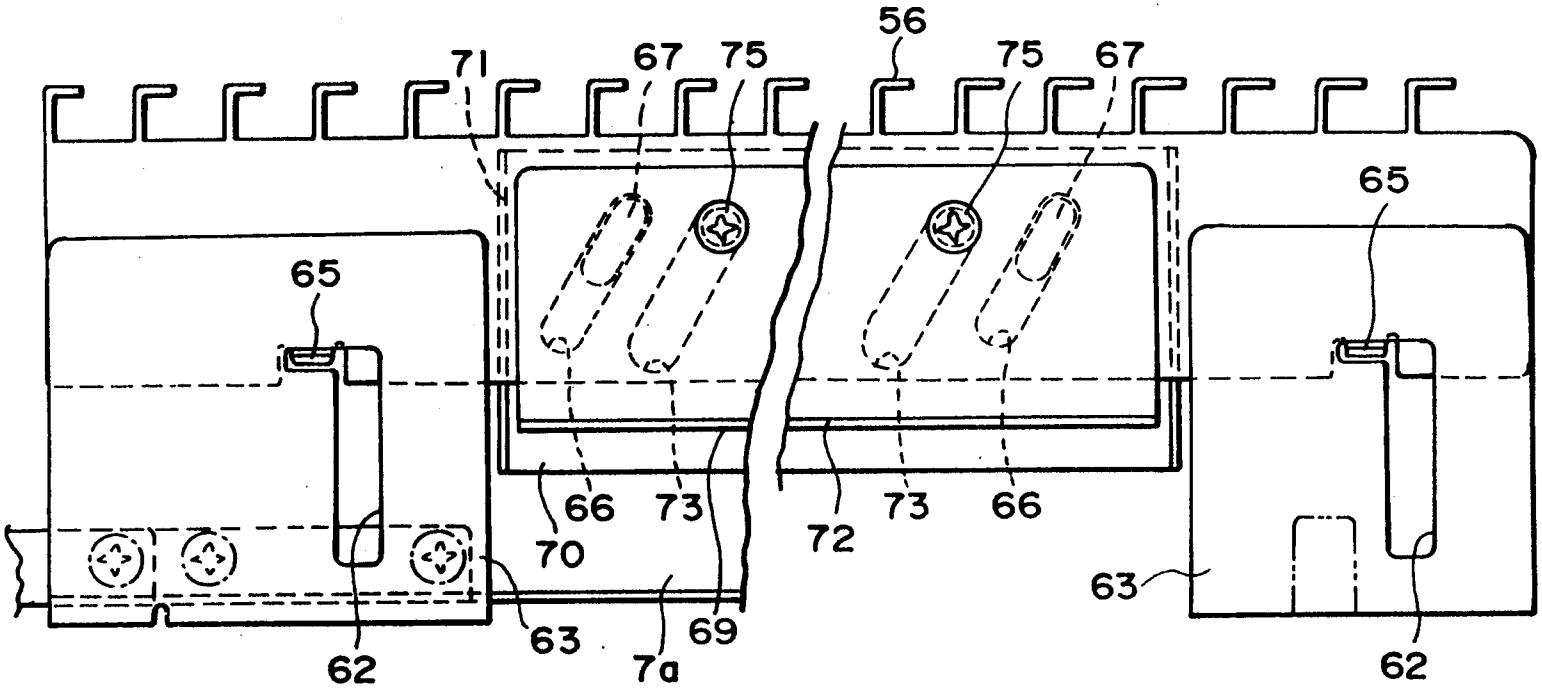
FIG. 13 is an enlarged front view illustrating a lower pawl operating mechanism.
Figure 14:
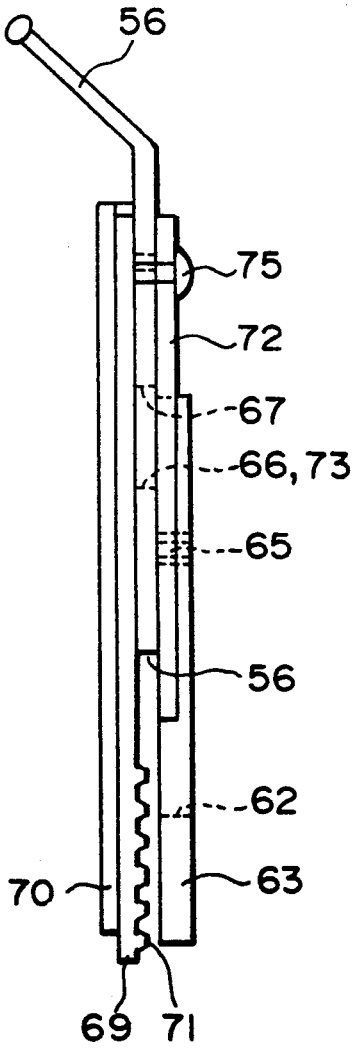
FIG. 14 is an enlarged view of the structure shown in FIG. 13.

Further referring to FIGS. 13 and 14, an operating mechanism for the lower pawl 56 will be described in detail. FIG. 13 shows a front view, and FIG. 14 shows a side view, of the operating mechanism. A guide plate 63 is provided with a groove 62 at insides of both sides of the lower pawls 56. The groove 62 has a horizontal and vertical portions. The guide plate 63 is mounted on the ring opener main assembly 7*a*. Projections 65 of the plate having the lower pawls 56 are guided along the groove 62. At the middle of the lower pawls 56, a pair of slanted groove 66 is formed. A slanted projection 67 slidingly guided by the slanted slot 66 is formed on a driving plate 70 which is vertically movable. The driving plate 70 is supported for vertical movement on the ring opener main assembly 7*a*. The driving plate 70 is provided with a rack 71 which is in meshing engagement with an end gear of the gear train 57. At the front side of the lower pawls 56, a confining plate 72 is provided, and the confining plate 72 and the driving plate 70 are fixed by screws 75 penetrating a slanted loose groove 73 of the member having the lower pawls 56.

Figure 3:
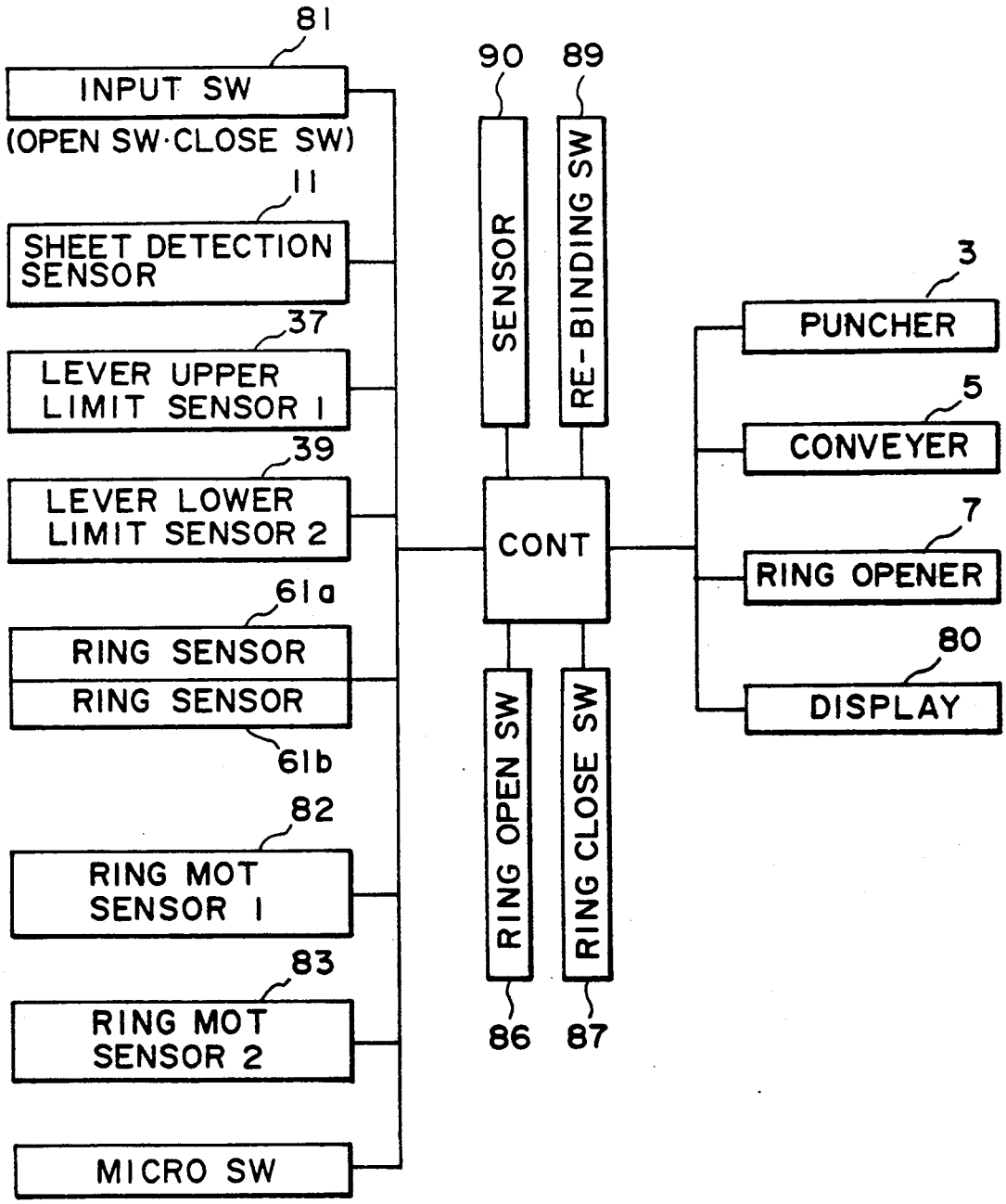
FIG. 3 is a block diagram illustrating a control system of the apparatus.
Figure 15:
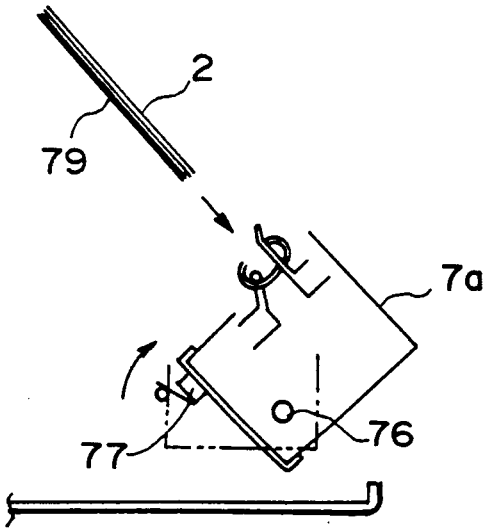
FIG. 15 is a side view in a manual mode.

As shown in FIG. 15, there is provided a pin 76 for rotatably supporting the main assembly 7*a* of the ring opener 7 on the base 1*a*. When the main body 7*a* is inclined and fixed with the inclination, a microswitch 77 produces a signal. As shown in FIG. 3, a ring opening button 86 and a ring closing button 87 are provided. Further, as shown in FIG. 3, a re-binding button 89 is provided. Below the conveying table 50, a sensor 90 for detecting the sheet materials 2 is disposed.

The inclination and the fixing of the main assembly 7*a* may be accomplished by a rail type stopper mechanism or a magnet attraction type.

Figure 2A:
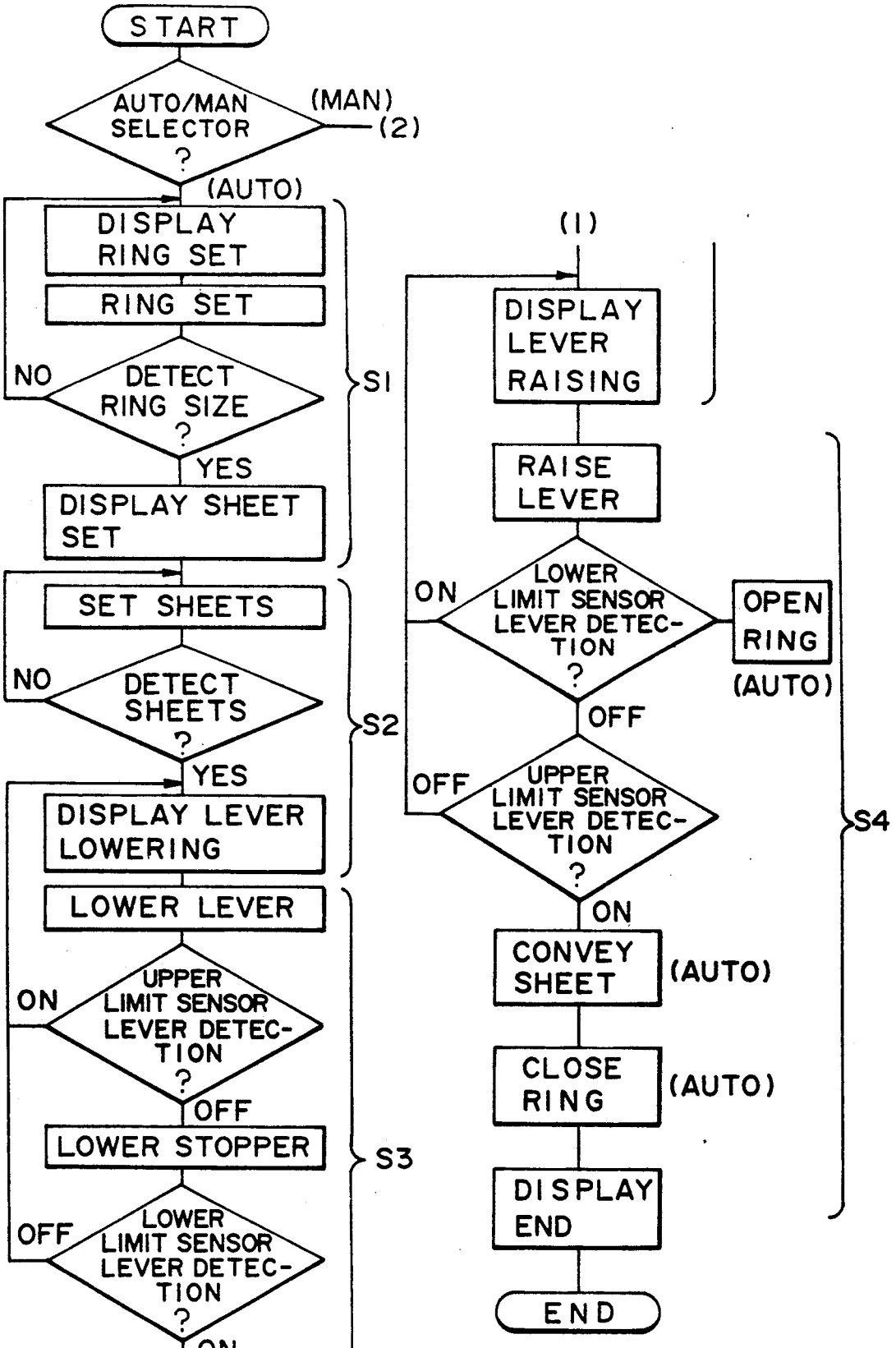
FIGS. 2A and 2B are flow charts illustrating operation of the apparatus.

Referring to FIG. 2A and 3, the operation of the apparatus constructed in the manner described above will be described. In FIG. 2A, an automatic mode is selected, and a switch 81 is actuated. When the fingers of the ring 6 are set on the upper pawls 52, the sensor lever 60 rotates in the counterclockwise direction about the shaft 60*a* by being pushed by the outer periphery of the ring. In response thereto, the controller 79 receives from the sensors 61*a* and 61*b* a signal representing a size of the ring 6 and a signal representing the presence of the ring 6. The controller 79 transmits a signal to a display 80 to display a message that the sheets are to be set (S1).

At this time, the controller 79 selectively actuates the solenoid 13*a* or 13*b*, in accordance with, the size of the ring 6 detected so as to project the stopper 12*a* or 12*b* through the hole 10*b* of the die 10. Then, the sheets are inserted until they are stopped by the stopper 12*a* or 12*b*. Then, the controller 79 receives a signal from the sensor 11, and a message is displayed on the display 80 that the lever is to be lowered (S2). Then, the operator lowers the lever 16. When the upper limit sensor 37 is deactuated by the disappearing of the sensor lever 36*a*, a signal indicative of that event is transmitted to the controller 79. Then, the elevated one of the solenoids 13*a* and 13*b* is lowered to lower the stopper 12*a* or 12*b*. Simultaneously, the pushing arm 29 is lowered by the lever arm 30, by which the sleeve 23 lowers against the spring forces by the compression springs 27*a* and 27*b*, by which the confining plate 26 integral with the pushing rods 25 presses the set of sheet materials 2. The lowered confining plate 26 is locked by the pawls 31*a* of the locking plate 31. Simultaneously, the punches 17 are lowered to punch the set of sheet materials on the die 10. Simultaneously, the pick-up arm 42 is lowered by the sensor lever 36*b* against the upward urging force. Then, the pick-up lever 41 lowers, and the upper conveying roller 40*b* and the lever 44 presses downwardly the set of sheet materials 2 by the weight thereof. Simultaneously, the controller 79 receiving a signal from the lower limit sensor 39 now actuated deenergizes the solenoid 47, upon which the lever 41 is locked through the core rod 47*a*, a locking portion 46*a* of the hook 46 and the projection 41*c*, and also a message indicative that the lever is to be raised is displayed on the display 80 (S3).

In this case, if the bottom surface of the confining plate 26 is pressed to the set of sheet materials 2 before the punching edges of the punches 17 reach the set of sheet materials 2, the sheet materials 2 are confined before the start of the punching action, so that the possible disturbance (misalignment) of the sheet materials 2 can be prevented. This can be accomplished by adjusting the compression springs 27*a* and 27*b*. Even if the confining plate 26 is pressed to the sheet materials 2 earlier, excessive compression force to the pushing rods and the sleeves 23 can be avoided by the provision of the compression springs 27*a* and 27*b*.

When the lever 16 is raised to such an extent that the sensor lever 36*b* deactuate the lower limit sensor 39, the controller 79 receives a signal indicative of this event, upon which the controller 79 opens the ring 6. On the other hand, when the sensor lever 36*a* actuates the upper limit sensor 37, the punches 17 have been retracted by the lever 16 through the pressing arm 29.

With a delay from completion of the retraction of the punches 17 from the sheet materials 2, the locking plate is rotated by the upward movement of the pressing arm 29, in the counterclockwise direction about the pin 32 through the arm 35 and the releasing link 33, upon which the confining plate 26 is released from the pawl 31*a*, upon which the confining plate 26 is moved away from the sheet materials 2.

The controller 79 receiving the actuation of the upper limit sensor 37 produces signals for actuating the stepping motor 8 for driving the conveying rollers 40*a* and 40*b*. The sheet materials are conveyed to the ring opener 7 by the conveying rollers 40*a* and 40*b* through a distance corresponding to a predetermined number of pulses. During the movement, the leading edges of the sheet materials 2 are prevented from being disturbed, by the inlet guide 51. The set of sheet materials is stopped at a proper position relative to the ring 6 which is opened a shown in FIG. 12, and thereafter, the ring 6 is closed.

The controller 79 receiving a signal representative of the stepping motor 8 stop produces a signal for deenergizing the solenoid 47, upon which the projection 41*c* is disengaged from the engaging portion 46*a*, and the upper conveying roller 40*b* is raised by the urging force by the tension spring 41*d* through the engaging portion 41*e* of the lever 41 and through the lever 44. After the ring 6 is closed, the display indicative of the completion of the binding operation is made on the display 80. This is the end of the binding operation (S4). After the completion, the operator pulls the bound sheet materials 2 in the direction opposite to the setting direction. At this time, the ring inlet guide 51 and the inlet guide 49 (FIG. 9) rotate in the clockwise direction so as not to impede the pulling action.

Referring to FIGS. 13 and 14, the operation of the lower pawls 56 will be described. The rack 71 is lowered by the motor 59 through the gear train 57 shown in FIG. 1. Then, the driving plate 70 lowers along an unshown guiding plate. The slanted projection 67 of the driving plate 70 applies a rightward force component to the lower pawls 56 through the slanted groove 66 in FIG. 13. By this, the projections 65 of the lower pawl 56 assembly are guided along the horizontal portions of the groove 62 of the guiding plate 63 to be moved rightwardly, by which the lower pawls 56 become engageable with the fingers of the ring 6. Subsequently, they are guided by the vertical portions of the groove 62 by the downward component force, by which the lower pawls 56 lower to open the fingers of the ring 6 downwardly. When the rack 71 is pressed upwardly by the motor 59, the lower pawls 56 move downwardly on the contrary. The confining plate 78 is integral with the driving plate 70 by the screws 75 to always retain the lower pawls. Therefore, the screws 75 make the same movement as the slanted projection 67. In consideration of this, a slanted loose hole 73 similarly to the slanted groove 66 is formed in the lower pawl 56 assembly.

In the foregoing embodiment, the bound sheet materials 2 are manually pulled out in the direction opposite to the sheet setting and conveyance direction. However, the bound sheet materials 2 may be automatically retracted by reversely rotating the motor 8 for driving the conveying rollers 40*a* and 40*b* when the completion of the binding operation is displayed on the display 80 without deenergizing the solenoid 47. By doing so, the labor for the binding operation can be saved, and the working period can be saved, too.

Next, the description will be made as to the manual mode. As shown in FIG. 15, when the main assembly 7*a* is inclined and fixed, the microswitch 77 is actuated, in response to which the controller 79 switches the control system into a manual mode. This mode is used when the punching power of the punch 17 or the like per one punching operation is not enough in relation to the binding capacity of the ring 6. By punching a plurality of times, and the binding operation is repeated. In addition, it is used when the sheet materials are to be exchanged. Thus, the manual mode is used, when the automatic mode is not convenient.

In the manual mode, the sheet materials 2 are not automatically conveyed, and therefore, the ring 6 is independently opened or closed by operating the ring opening button 86 and a ring closing button 87.

Figures 16A, 16B:
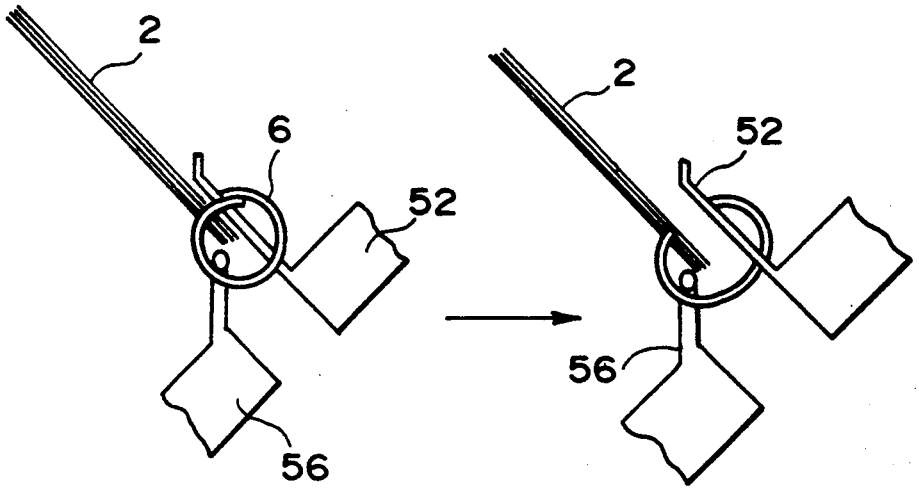
FIG. 16(*a*) is a side view of the apparatus when the ring is closed in a manual operating mode.

When a sheet material or materials 2 are desired to be added, or when a part or all of the bound sheet materials are to be exchanged, the sheet materials 2 are set below the upper pole 52, as shown in FIG. 16(*a*). Then, the ring opening button 86 is operated, by which the sheet materials 2 may be freely removed, as shown in FIG. 16(*b*). Therefore, the adding or exchanging operation can be possible.

By inclining the main assembly 7*a*, the apparatus can be easily watched, and the apparatus can be easily operated.

Figure 2B:
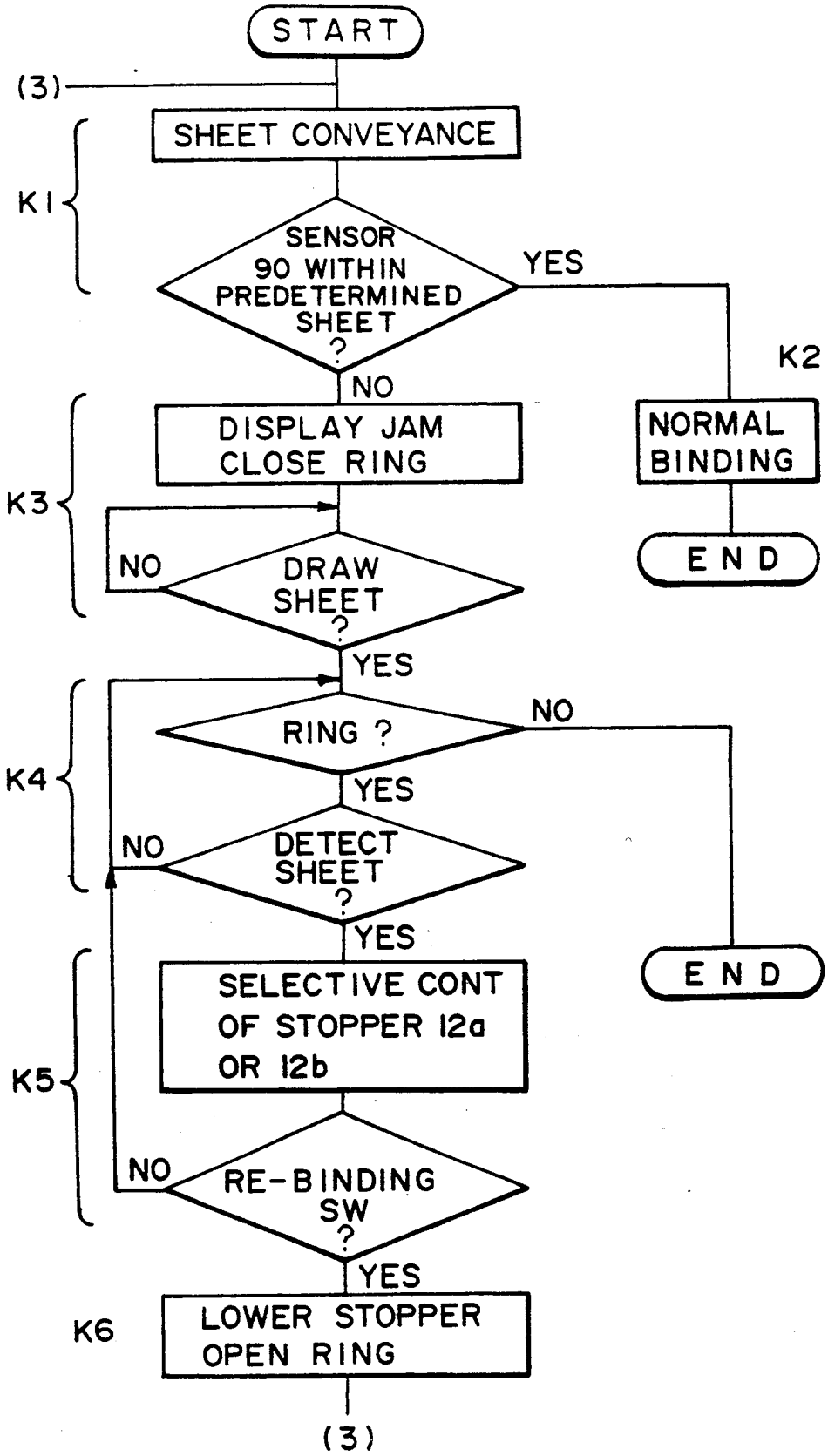

Referring to FIG. 1, FIG. 2B and FIG. 3, a re-binding operation after a sheet conveyance error is detected during the operation in the automatic mode, will be described. A jam delay (conveyance error) is detected when the sensor 90 does not detect the sheet materials 2 within a predetermined period of time after the sheet materials 2 are punched and are conveyed to the conveying table 50 by the rollers 40*a* and 40*b*.

In order to perform this detection, at step S4 (FIG. 2A), the operation shown in FIG. 2B starts from the start of the sheet material conveyance.

At step K1, the sensor 90 detects the sheet material within the predetermined period of time. Then, step K2 is executed, by which the proper binding operation is completed.

However, if the sensor 90 does not detect the sheet materials 2 within the predetermined period, the step K3 is executed by which "JAM" is displayed on the display 80, and the ring 6 is closed by the ring motors 55 and 59. Then, a display is made to the effect that the operator is to pull out the sheet materials 2. When the sheet materials are pulled out, step K4 is executed, and the ring 6 is detected by the sensor 61.

The sheet materials 2 are inserted again, and when the sheet materials 2 are detected by the sensor 11, step K5 is executed, in which a stopper 12*a* or 12*b* corresponding to the size of the ring 6 is raised. A display is made to the effect that the re-binding button 89 is to be actuated. When this is actuated by the operator, step K6 is performed, in which the punching operation is omitted, and the stoppers 12*a* or 12*b* raised is lowered. Simultaneously, the ring 6 is opened, and the operation is shifted to the flow (3) to perform the conveyance and the re-binding of the sheet materials 2. Then, the above-operation is repeated. If the ring 6 is not detected at step K4 it is discriminated that the operator stops the operation before the completion, and the operation is stopped.

A modification will be described. In this modification, when the sheet materials 2 are not detected by the sensor 90 within the predetermined period of time, that is, when the conveyance error of the sheet materials 2 occurs, the sheet materials are pulled out, and then, they are inserted again. Then, the lever 16 is slightly lowered, and then, it is raised. By this, the upper limit sensor 37 is deactuated, and thereafter, it is actuated (since the lower limit sensor 39 is not actuated, the non-completion of the punching operation is discriminated). In response to such a combination of signals, the conveying station 5 and the ring opening station 7 are automatically operated to allow the re-binding operation.

By doing so, the provision of the re-binding button 89 becomes not necessary, so that the structure of the apparatus 1 can be simplified.

Another modification will be described. In this modification, after the conveyance failure is detected by the sensor 90, the ring opening and closing buttons 86 and 87 operable during the manual mode are permitted to be operated for the purpose of the re-binding operation without changing the operational mode (automatic mode), in response to the conveyance failure detection signal.

By doing so, similarly to the foregoing modification, the re-binding button 89 may be omitted.

A second embodiment of the present invention will be described in which in addition to the structures described in conjunction with FIGS. 1-16, means is provided to control the opening operation of the resin ring and the degree of the opening of the resin ring, by operating a button by a predetermined degree.

Figure 17:
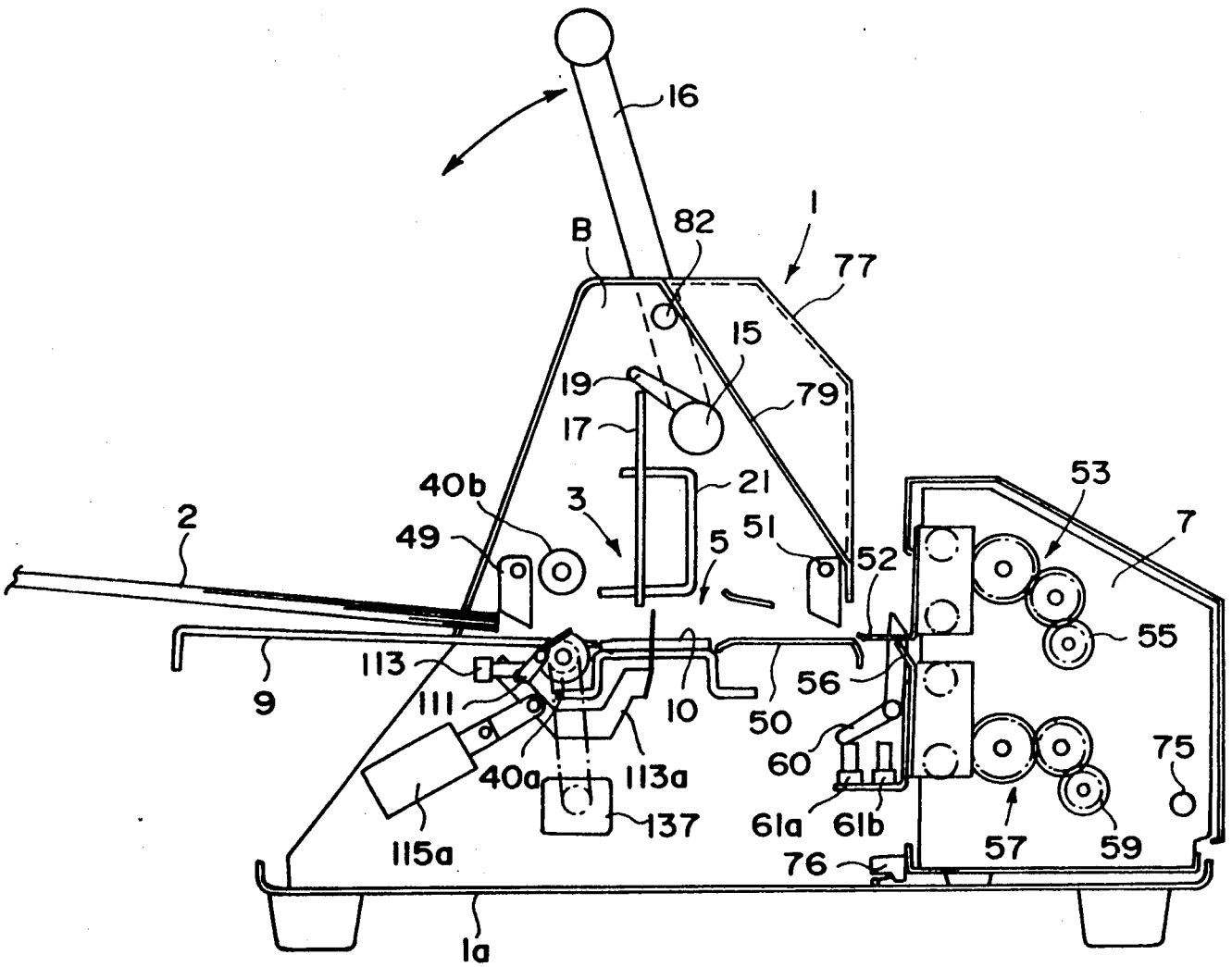
FIG. 17 is a sectional view of a sheet material binding apparatus according to a second embodiment of the present invention.
Figure 18:
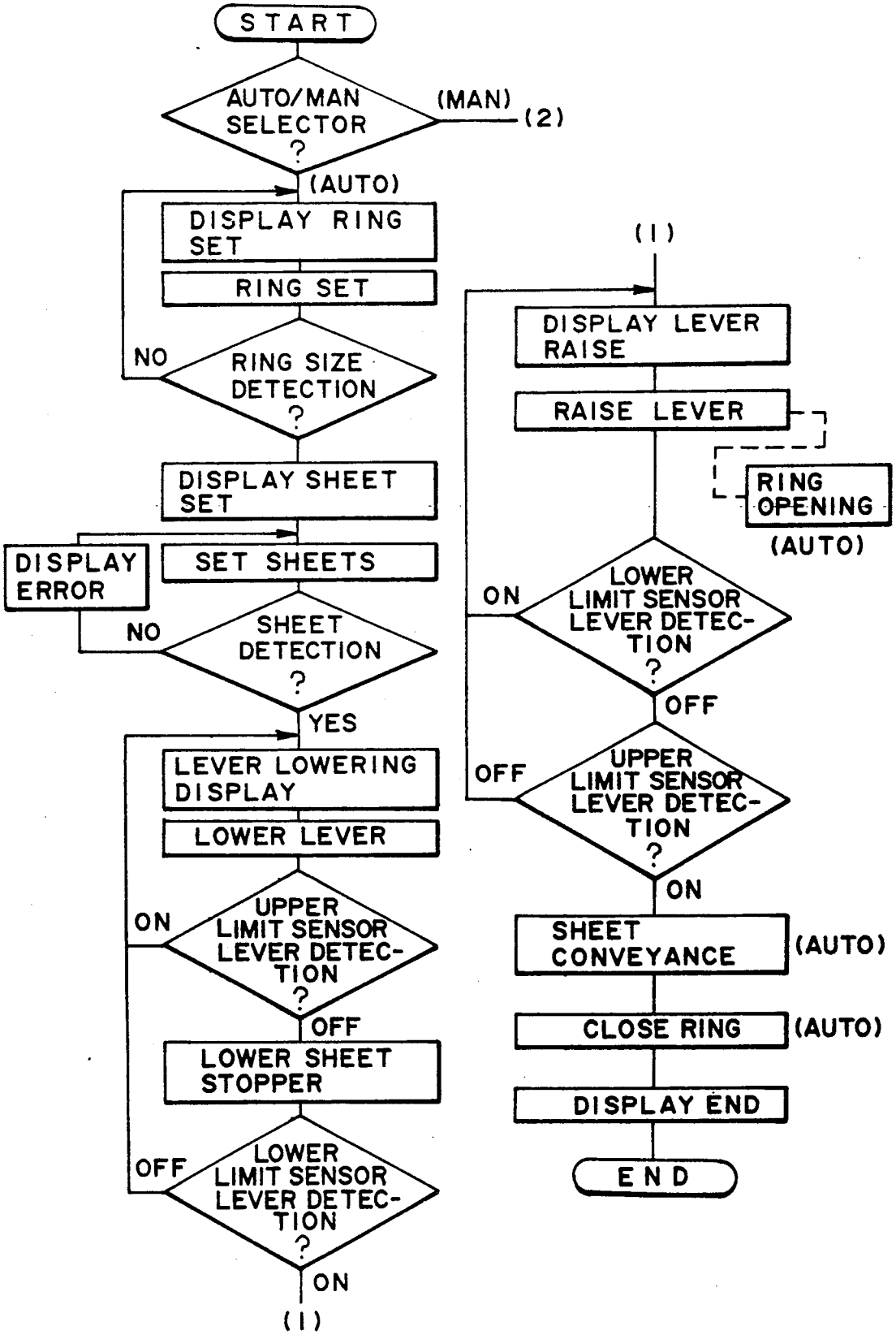
FIG. 18 is a flow chart illustrating an operation of the apparatus of the second embodiment.

FIG. 17 is a sectional view of the sheet material binding apparatus according to the second embodiment of the present invention. FIG. 18 is a flow chart illustrating the operation of the apparatus. The flow chart of FIG. 18 deals with an automatic mode wherein the automatic operation is performed from the punching of the sheet materials to the binding of them and a manual mode wherein the punching operation and the binding operation are performed independently from each other.

The description will first be made as to the structure of the apparatus of this embodiment.

Referring to FIG. 17, the punching means 3 will be described. As shown in this Figure, a die 10 is disposed adjacent to a tray 9 for supporting the sheet materials 2. Through holes formed in the die 10, an end of a sensor lever 111 for detecting presence or absence of the sheet materials 2 and a lower conveying roller 40*a* are extended. The other end of the sensor lever 111 is associated with a sensor 113 for detecting the sheet materials 2.

Figure 25:
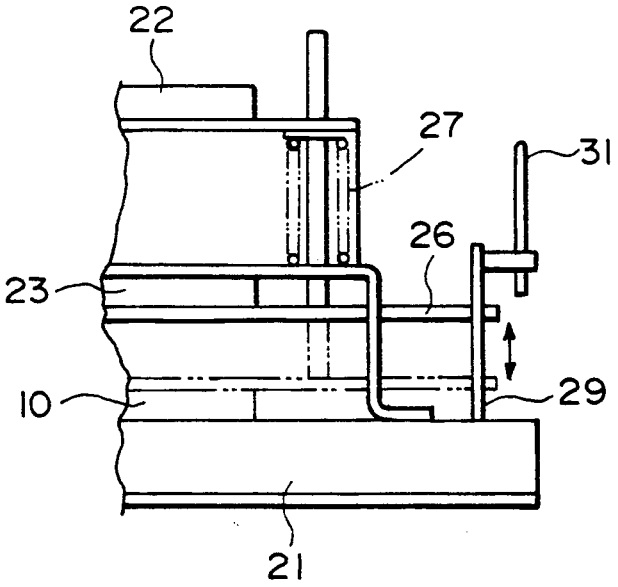
FIG. 25 is a front view of sheet confining means.
Figure 26:
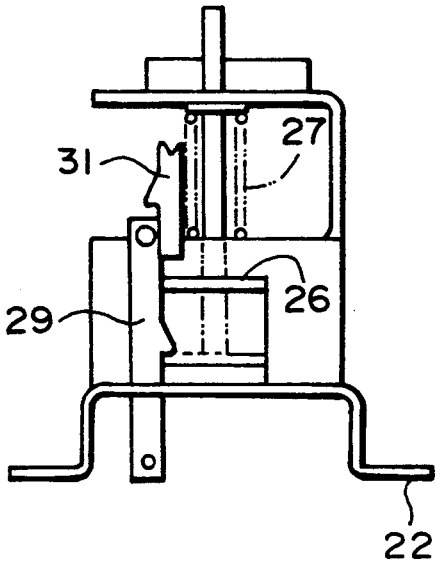
FIG. 26 is a side view thereof.

As shown in FIGS. 17, 5 and 6, a shaft 15 to which the lever 16 is fixed is provided with an arm 19 fixed thereto. When the lever 16 is rotated downwardly, the punch 17 is lowered along the guides 22 and 23 formed on the supporting table 21, so that the punch 17 penetrates through the punching holes 10*a* of the die 10. As shown in FIGS. 5, 25 and 26, to the base 22*a*, the die 10 and the supporting frame 21 are fixed. On the supporting frame 21, the guides 22 and 23 are fixed. When the lever 16 is rotated downwardly, the supporting frame 21 is lowered, and the confining plate 26 is lowered at this time, by which the sheet materials 2 are confined. The lower position of the confining plate 26 is locked by the locking plate 29, and a releasing plate 31 is effective to release the locking action.

Figure 10:
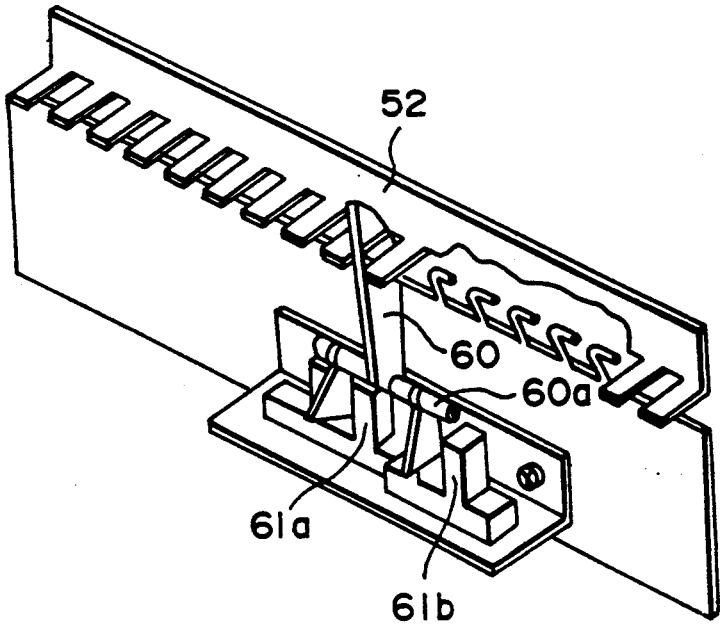
FIG. 10 is a perspective view illustrating upper and lower pawl.
Figure 11:
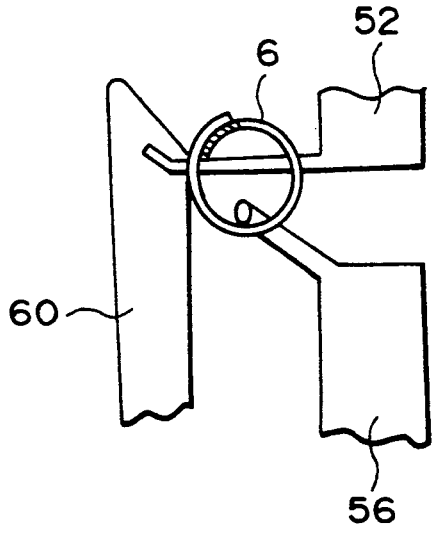
FIG. 11 is a side view illustrating a binding member set in the upper pawl.
Figure 12:
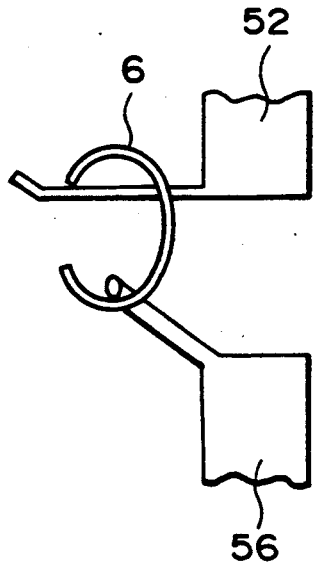
FIG. 12 is a side view wherein the binding member is opened.

The operation in the automatic mode will b described in conjunction with FIGS. 17 and 18. First, the resin ring 6 is set on the upper supporting member 52 shown in FIG. 1 described hereinbefore. At the initial stage, the ring sensor lever 60 is pressed to the upper supporting member 52 by an elastic member. However, when the resin ring 6 is set on the upper supporting member 52, it rotates in the counterclockwise direction as seen in FIGS. 10 and 11. By this, the lower portion interrupts the light paths of the ring sensors 61*a* and 61*b*, so that the presence of the resin ring 6 is detected. A plurality of such ring sensors 61*a* and 61*b* are provided to determine the size of the resin ring 6 on the basis of a combination of ON/OFF of the sensors.

A plurality of sizes of the resin ring 6 are prepared in consideration of the thickness of the set of sheet materials to be bound. The values to be used in the subsequent step or steps are determined on the basis of the detection of the size of the ring, so that the automatic operation after the punching operation is accomplished.

The sheet materials 2 are inserted from the operation side (left side in FIG. 17). At this time, similarly to FIG. 4, the sheet materials 2 are abutted to the stopper 113*a*, by which the punching position of the sheet materials 2 is determined. In addition, the sheet material confining means (inlet guide) 49 functions to prevent the leading edges of the sheet materials 2 from being raised.

Figure 21A:
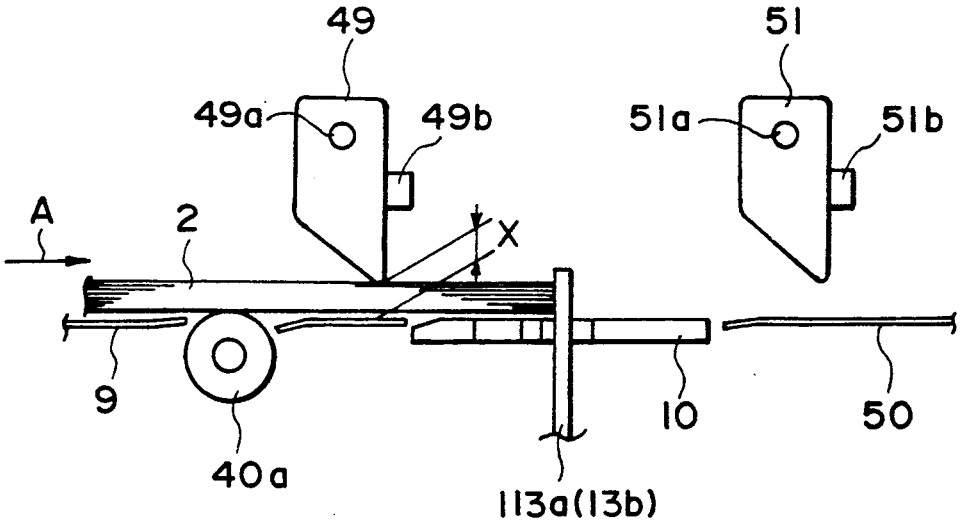
FIGS. 21(*a* and *b*) is a side view of a conveying passage.

During the binding operation of the sheet materials 2, the sheet materials 2 are inserted in the direction indicated by an arrow A in FIG. 21A. At this time, the sheet material confining means 49 abuts a regulating stopper 49*b* by its weight, and therefore, it is retained there to maintain a constant gap x between the sheet material limiting means 49 and the die 10. The gap x is determined by the punching power, so that the set of sheet materials 2 having a thickness larger than the gap x is not permitted to be inserted, by the sheet material regulating means or control means 49. Thus, the possible failure in the punching operation and/or the binding operation is prevented.

Figure 21B:
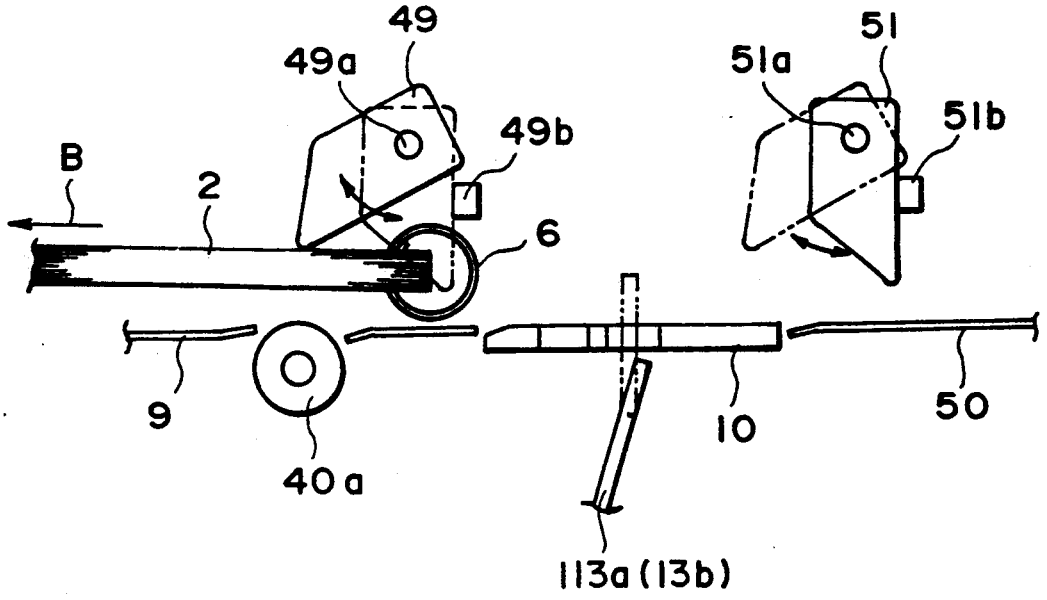

The sheet materials 2 having been inserted, punched and bound, are pulled out in the direction B in FIG. 21B. At this time, the leading edges of the sheet materials 2 have the resin ring 6 binding the sheet materials, therefore, the maximum thickness of the set of the sheet materials 2 is increased. Since, however, the sheet material limiting means 49, as shown by solid lines in FIG. 21B, is retractable in the clockwise direction, it does not impede the pulling action. Thus, it arrows smooth pulling of the sheet material 2. As described in the foregoing, the thickness of the sheet materials 2 is limited by the sheet material control or limiting means 49, and therefore, the trouble of failures in punching and/or binding operation, so that the binding operation in total is stabilized. In addition, by placing the sheet materials 2 on the supporting tray 9, the sensor lever 111 rotates to interrupt the light path of the sheet sensor 113 to detect the presence of the sheet materials 2.

Next, the punching operation will be described. As shown in FIG. 6 described hereinbefore, a punch 17 is supported by guides 22 and 23 constituting a couple with the die 10. The vertically independent structure is intended to permit the sheet materials 2 after being bound by the resin ring 6 to be pulled out to the inlet side after the completion of the operation.

In order to punch the sheet material 2 being abutted to the stopper 13*a* or 13*b*, the lever 16 is lowered. The position of the lever 16 is detected by the sensor levers 32*a* and 32*b* rotating together with the lever 16, and by the upper limit sensor 35 and the lower limit sensor 36. By the lowering of the lever 16, a cam mechanism cooperable with a shaft 15 lowers and raises the punch 17 to punch the sheet materials 2.

The mechanism will be described in more detail. By lowering the lever 16, the lower limit sensor lever 32*b* rotates to interrupt the light path of the lower limit sensor 36, and simultaneously, it lowers the pick-up arm 42. By this, the pick-up lever 41 rotatable together with the pick-up arm 42 is lowered, and the upper conveying roller 40*b* lowers by its weight to cooperate with the lower conveying roller 40*a* to confine the sheet materials 2 to accomplish stabilized conveying operation. At this time, in order to prevent the pick-up lever 41 from returning, a pin 41*c* fixed on the pick-up lever 41 is engaged with a pawl 46*a* at an end of a locking arm 46.

After the sheet materials 2 are punched, the lever 16 is raised to retract the punch 17 from the sheet materials 2. At this time, the sheet materials 2 are raised by the friction between the punch 17 and the sheet materials 2, and is abutted to the guide 23, upon which the punch 17 is retracted from the sheet materials 2. If this occurs, the sheet materials 2 are pulled inclinedly, with the result that the sheet materials are deviated from a position determined by the stopper 13*a* or 13*b*. To prevent this, the sheet materials are confined by the sheet material confining mechanism shown in FIG. 26.

The mechanism will be described. At the initial stage, the mechanism is pressed to the guide 23 by a spring 27. However, it lowers together with the operation of the lever 16 to confine the sheet materials 2, so that the deviation of the sheet materials 2 during the punching operation is prevented. After the sheet materials 2 are punched, a locking plate 29 prevents the returning of the mechanism to assist the pulling of the punch 17. Immediately before the lever 16 interrupts the upper limit sensor 35, that is, at the timing when the punch 17 is pulled out from all of the sheet materials 2, the mechanism is restored by a cam mechanism of a releasing plate 31. By this, the mechanism is reset.

When the upper limit sensor 35 detects the completion of the punching operation, the selected one of the stoppers 13*a* and 13*b* is retracted by the solenoid 15*a* or. 15*b*. Thereafter, the conveying motor 37 simultaneously rotates the lower conveying roller 40*a* and the upper conveying roller 40*b* to convey the sheet materials 2 through the belt and the gear. The sheet materials 2 may be conveyed by one of either one of the upper or lower conveying rollers 40*a* and 40*b*. In order to assure a large number of sheet materials to be conveyed, they are preferably driven by both of the rollers.

The conveyed sheet materials 2 are supplied to the ring opening station through the conveying table 50. The conveying passage is provided with a ring inlet limiting plate 51 to limit the gap of the inlet to prevent the curling and disturbance of the leading edges of the sheet materials 2 so as to assure the binding of the sheet material 2 by the resin ring 6.

The punching and conveyance of the sheet materials 2 are described in the foregoing. Then, the ring opening station 7 will be described. The ring opener, as shown in the right half of FIG. 17, comprises an upper supporting member 52, a lower supporting member 56, gear trains 53 and 57 for driving them, respectively, motors 55 and 59 and a sensor for detecting the size of the resin ring 6.

Figure 19:
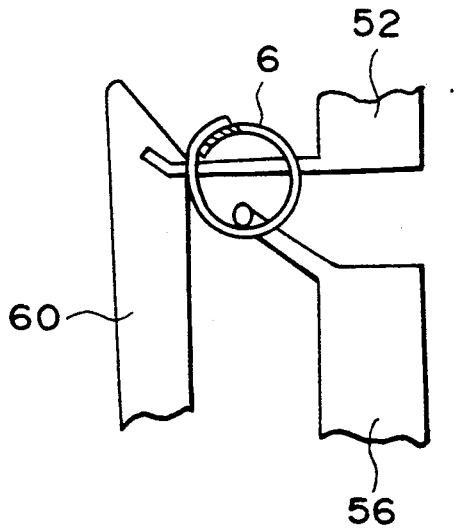
FIG. 19 is an enlarged view when the ring is set.
Figure 20:
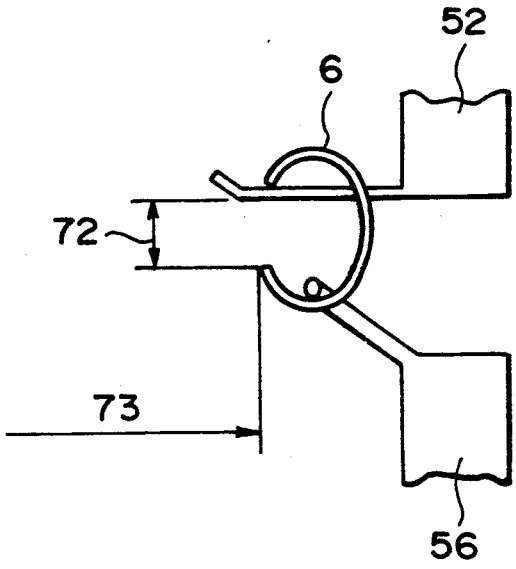
FIG. 20 is an enlarged view when the ring is opened.

As described in the foregoing, when the resin ring 6 is inserted between the upper supporting member 52 and the ring sensor lever 60, the size of the resin ring 6 used is detected, and degree of opening of the resin ring 6 is determined. At this time, the degree of opening is different depending on the size of the used resin ring 6. The amounts of movements of the upper supporting member 52 and the lower supporting member 56 by which the resin ring 6 is opened, is different depending on the size of the resin ring 6. Referring to FIGS. 19 and 13, the opening operation of the resin ring 6 will be described. The resin ring 6 set is supported by the upper supporting member 52, and is sandwiched between it and the ring sensor lever 60. The lower supporting member in the form of a hook translates into the inside of the resin ring 6 by an unshown cam mechanism, as shown in FIG. 16. Thereafter, the upper supporting member 52 and the lower supporting member 56 are moved to provide the determined degree of opening.

In this embodiment, the opening operation is started as soon as the upper limit sensor 35 of the lever 16 detects the completion of the punching operation. However, the timing of the opening may be different if it is before the sheet materials 2 reach the predetermined position. The ring open state is as shown in FIG. 10. As regards the degree 72 of the opening of the resin ring 6 and the position 73 of the ring edge, they are empirically determined in the manner that as many as possible sheet materials 2 can be properly bound within the elasticity limit of the resin ring 6, so that they can be properly set without the operator wondering each time when the resin ring 6 is set.

The sheet materials 2 conveyed have been punched at positions determined in accordance with the size of the ring, and the sheet materials 2 are conveyed so that the punched holes are aligned with the ring edges 73. After the completion of the conveying operation, the upper supporting member 52 and the lower supporting member 56 are moved in the same direction in the manner that the degree of the opening of the resin ring 6 is retained. They are moved until the edges of the resin ring 6 penetrate through the punched holes of the sheet materials 2. After the penetration, the upper supporting member 52 and the lower supporting member 56 are moved so as to close the opening. Finally, the bound sheet materials 2 are pulled toward the operator. Since the limiting member 49 and the ring inlet limiting plate 51 are rotatable, they do not impede the retracting action of the sheet materials 2.

Figure 22:
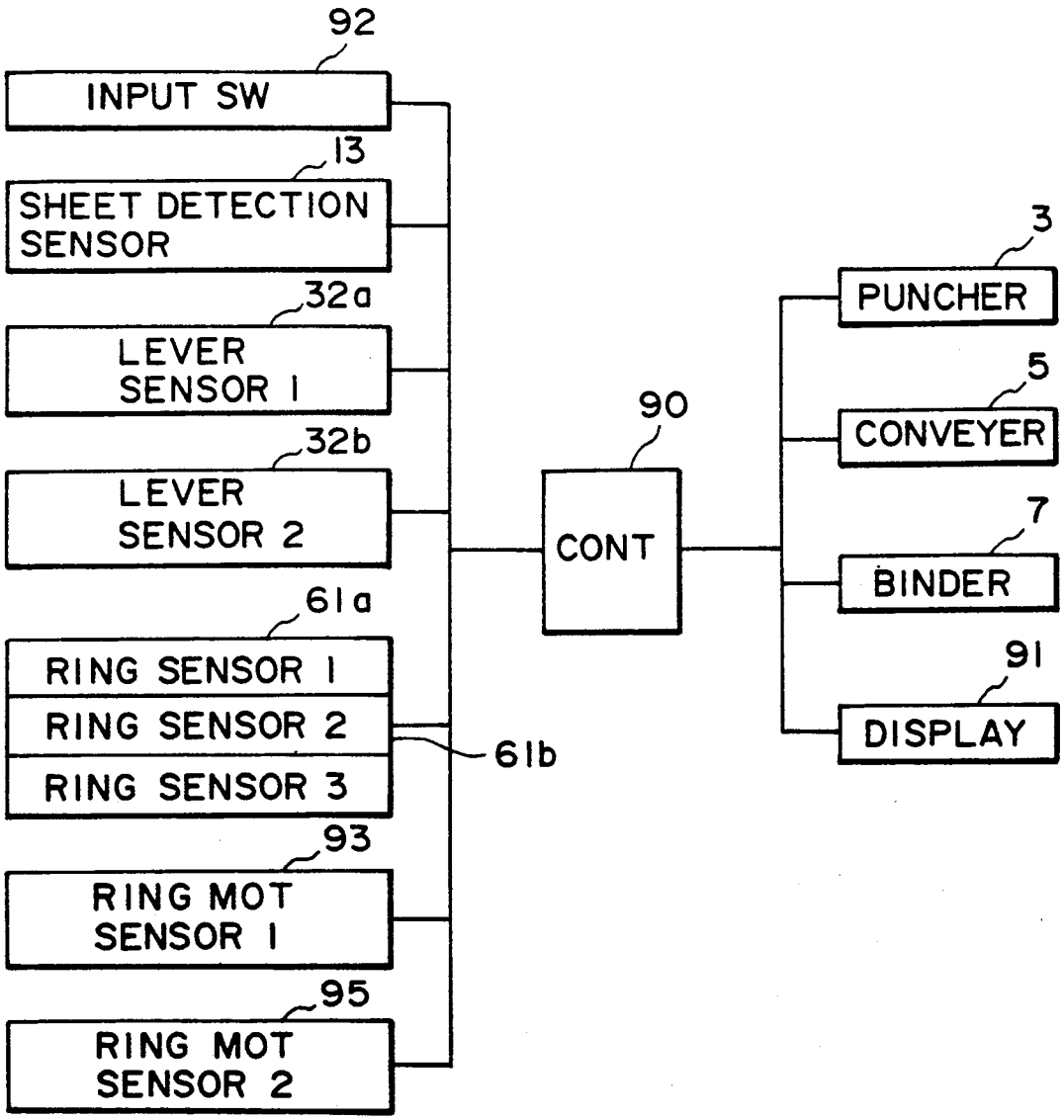
FIG. 22 is a block diagram of a control system.

The operations in each of the steps are displayed on the operating panel so that the operator is instructed sequentially until the final stage of the operation. FIG. 22 is a block diagram of a control system accomplishing it. Referring to FIGS. 17, 15, 23 and 24, the manual mode operation will be described. Usually, the automatic mode is usable when the number of sheet materials or a thickness of the set of the sheet materials 2 is lower than the maximum punching power of the punching station. When the number of sheet materials beyond the punching power are to be bound, the automatic mode is not used, and the sheet materials 2 are divided or grouped into plural sets of sheet materials 2 each having the number less than the maximum punching power, and the divided sets are respectively punched. Then, they are bound by the resin ring 6. When additional sheet material or sheet materials are desired to be added to the bound sheet materials, or when a part or all of the bound sheet materials are desired to the replaced with another sheet material or sheet materials, the manual mode, not the automatic mode, is used.

Figure 23:
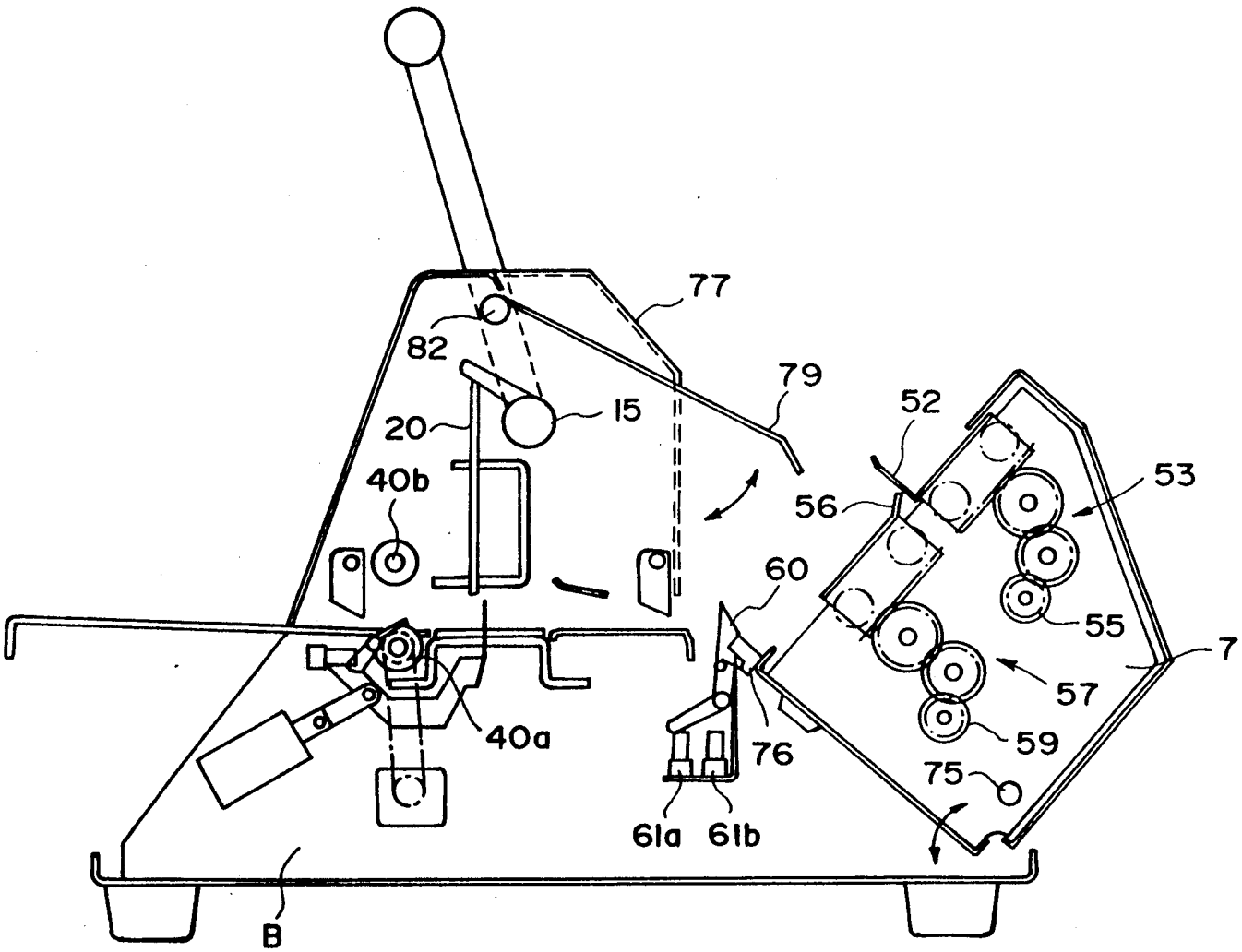
FIG. 23 is a side view of a sheet material binding apparatus in a manual mode.

When the sheet materials 2 are to be bound in the manual mode, the binding means 7 in FIG. 17 is rotated in the clockwise direction about the pivot 75, and it is fixed at the position shown in FIG. 23. At this time, the automatic-manual selector switch 76 mounted on the binding means 7 is rotated to become deactuated, upon which the selection of the manual mode is detected. An auxiliary guide cover 79 mounted on the cover 77 of the automatic sheet material binding device 1 also rotates in the counterclockwise direction to a position shown in FIG. 23. The auxiliary guide cover 79, during the automatic mode, is moved interrelatedly with an unshown cover of the binding means 7, and is retained at the position shown in FIG. 17. The cover 79, however, during the manual mode, is moved to a position shown in FIG. 23 by an elastic member not shown.

The operation will be described. The resin ring 6 used for the binding is opened by the upper supporting member 52 and the lower supporting member 56. The sheet materials 2 to be bound are grouped into plural sets each having a number or thickness less than the maximum punching power, in the manner described in the foregoing. Then, the sets of the sheet materials 2 are sequentially set to the pawl 6*a* of the resin ring 6 which is kept opened. When the desired sets of sheet materials 2 are set, the resin ring 6 is closed. Then, the sheet materials 2 are retracted, and the binding operation is completed. When the sheet materials 2 are set to the resin ring 6, the auxiliary guide cover 79, as shown in FIG. 15 functions as if it is a guide and a supporting table for the sheet materials 2. Therefore, the resin ring 6 is easily set with the sheet materials 2.

Since the rig sensors 61*a* and 61*b* are mounted on the automatic sheet material binding device 1, it is not usable when the binding means 7 is rotated into the manual mode. A plurality of sizes of the resin ring 6 are prepared, and therefore, the degree of the opening of the resin ring 6 is determined by the operator.

At this time, the degree of opening of the resin ring is stored in the apparatus for each of the sizes of the resin ring 6, and therefore, the operator sets the resin ring 6 on the upper supporting member 52, and thereafter, the depresses the ring opening button 80 shown in FIG. 23 an optimum number of times corresponding to the size of the resin ring. Then, the proper degree of opening of the resin ring 6 is provided. Upon completion of the setting operation, the ring closing button 81 is closed to close the ring 6. This is the end of the operation.

When sheet materials are to be added, or when a part or all of the bound sheet materials are to be exchanged, the sheet materials 2 are set such that the sheet material 2 are below the upper supporting member 52, as shown in FIG. 16. Then, similarly to the foregoing, the opening and closing operation of the resin ring 6 is performed, and the punching operation of the sheet material 2 is performed, by which the adding or exchanging operation is performed.

The apparatus of the second embodiment comprises punching means for punching the sheet materials, conveying means for conveying the sheet materials punched by said punching means to a binding position for binding the sheet materials by a resin binding member, binding means for binding the sheet materials conveyed by said conveying means with a resin binding member, wherein the apparatus is operable in an automatic binding mode and in a manual binding mode.

Wherein the opening of the resin binding member is controlled by operating a pressing button switch to a predetermined degree.

When the sheet materials are to be bound in the manual mode, the resin ring is set on the binding means, and a ring opening button is operated, by which the resin ring is opened to receive the sheet materials. The opening operation of the resin ring continues to the degree of opening predetermined empirically, so that the proper degree of the opening can be provided without expertise of the operator.

As described, according to the second embodiment of the present invention, in the manual binding mode of the automatic sheet material binding apparatus, the opening of the resin ring is controlled by actuating a switch to a degree predetermined empirically corresponding to the sizes of the resin ring. Therefore, unskilled operators can easily and efficiently manipulate the binding apparatus.

A third embodiment of the present invention will be described, in which in addition to the structures described in conjunction with FIGS. 1–16, there is provided switching means for selecting a mode in which the sheet materials are automatically conveyed immediately after they are punched and a mode in which the sheet materials are once retracted, and re-inserted, and thereafter they are automatically conveyed.

Figure 28:
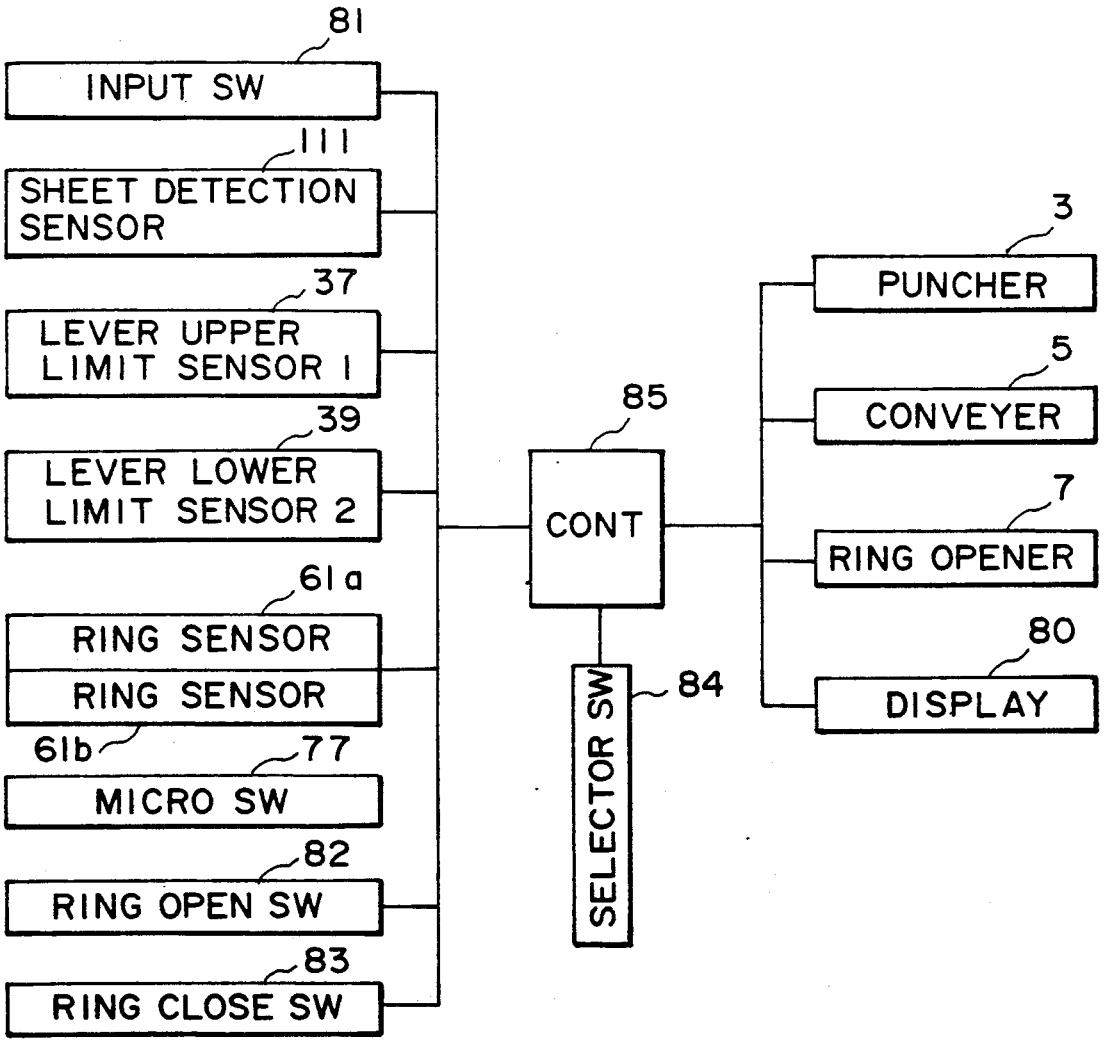
FIG. 28 is a block diagram of a control system.

Referring to FIG. 28, a switching structure including a switch 84 will be described. When the switch 84 is operated by one stage, the controller 85 responds to it to disable the function for actuating the stepping motor 8 for driving the conveying rollers 40*a* and 40*b* when the lever upper limit sensor 37 is deactuated and thereafter actuated. When the switch 84 is operated by two stages the controller 85 responds to it to disable the display of instructions of the lowering of the lever although the stepping motor 8 is actuated in response to a detection signal by a sheet detection sensor 111. When the switch 84 is returned, the regular automatic mode is selected.

Figure 27:
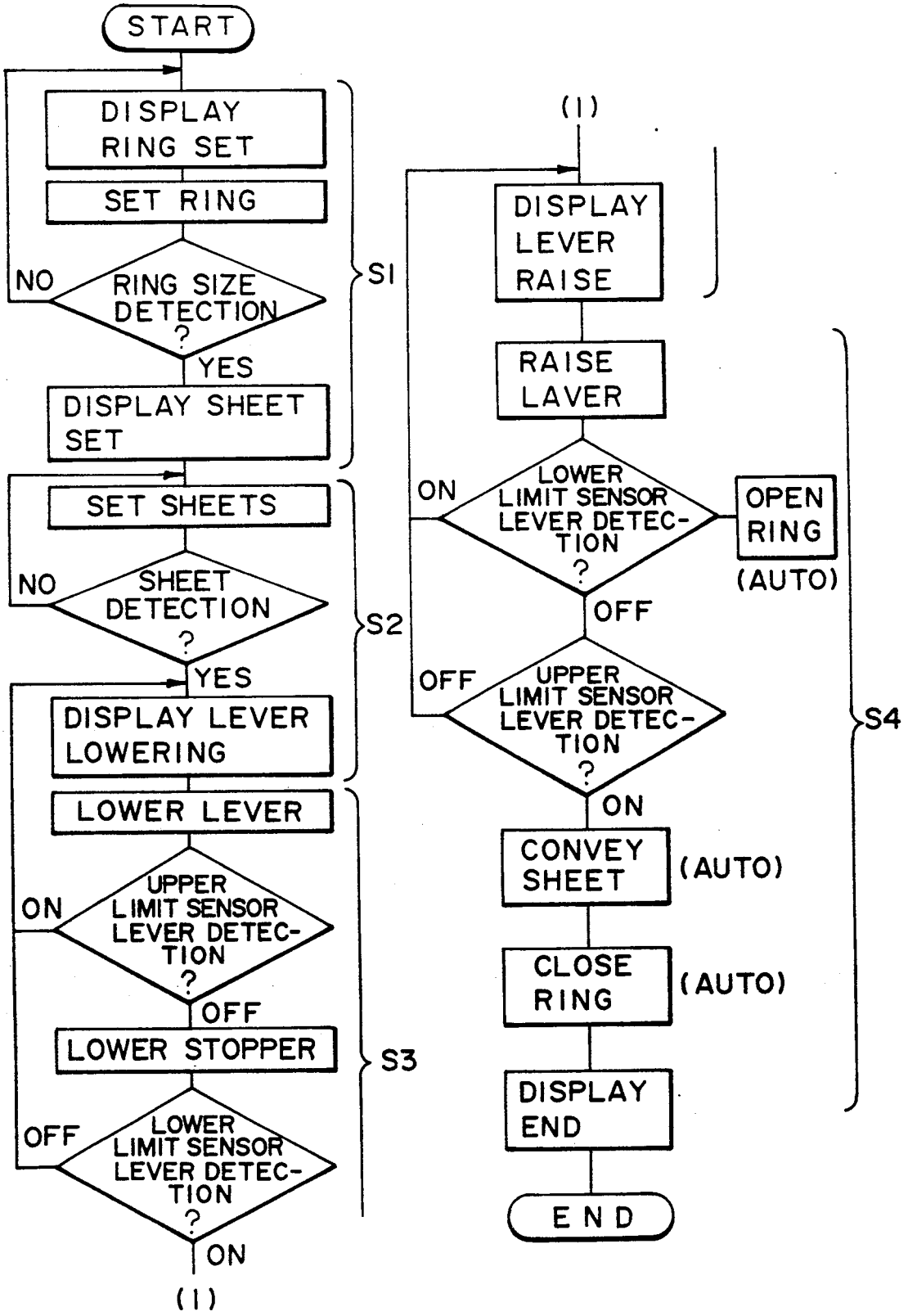
FIG. 27 is a flow chart in an automatic mode in an apparatus according to a third embodiment of the present invention.

Referring to FIGS. 27 and 28, the operation of this embodiment will be described.

First, the manual mode will be dealt with. As shown in FIG. 15, the main assembly 7*a* is inclined about the pin 76 and is fixed with the inclined state. Then, the microswitch 77 is actuated. Receiving the actuation signal, the controller 85 switches the control system to the manual mode. An auxiliary guide 79 rotates in the clockwise direction about the pin 79*a* to support and guide the sheet materials 2 during the manual mode.

Figure 24:
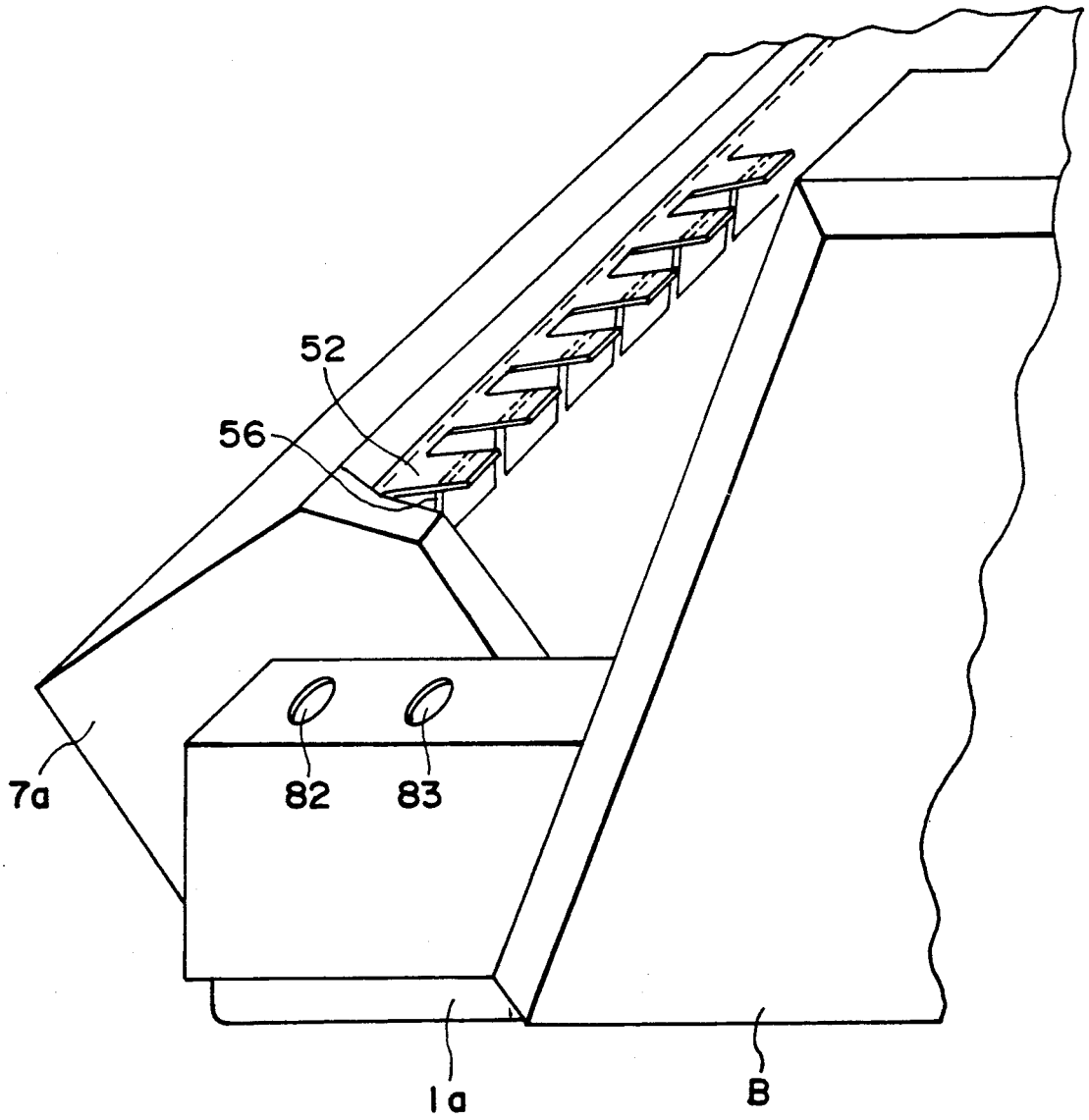
FIG. 24 is a rear perspective view thereof.

Since the sheet materials 2 are not automatically conveyed in the manual mode, the ring 6 is opened and closed by the ring opening button 82 and the ring closing button 83 shown in FIG. 24. The degree of the opening is decided by the operator. Since, however, the degree of the opening which is proper to the ring 6 to be used is stored in the controller 85 as in the automatic mode. Then, the operator depresses the ring opening button 82 an optimum number of times to provide the proper degree of the opening of the ring 6. Even if, the ring opening button 82 is depressed beyond a proper number of times, the ring 6 is not opened beyond the degree stored in the apparatus 1. Upon completion of the binding operation, the ring closing button 83 is depressed to close the ring.

The description will be made as to the operation when the number of sheet materials is beyond the tolerable level of the punching station 3 in the automatic mode.

The sheet materials are grouped into plural sets of sheet materials each having the number less than the tolerable level. This operation is not strict, and therefore, can be easily performed without specific difficulty.

Then, the switch 84 shown in FIG. 28 is operated by one stage. Then, a selected ring 6 is set at the ring opener 7. Then, the event that the ring is set is displayed on the display 80 in response to signals from the ring sensors 61*a* and 61*b*, and the solenoid 13*a* or 13*b* is energized, upon which a stopper 12*a* or 12*b* is projected through the hole 10*b*.

Then, the operator sets one of the grouped sheet materials 2 on the supporting tray 9, and the leading edges thereof are abutted to the stopper 12*a* or 12*b*. The sensor 11 produces a signal, upon which the display of instructing the lowering of the lever 16 is made on the display 80. Then, the operator lowers the lever 16. When the lower limit sensor 39 is actuated, the display 80 responsive to the signal indicative of the actuation of the lower limit sensor 39 displays the instruction of raising the lever 16. Then, the operator raises the lever 16. Here, even if the upper limit sensor 37 is actuated, the motor 8 is not actuated.

Subsequently, the punched sheet materials 2 are pulled out. The above-operation is repeated for all of the remaining sets of sheet materials 2. Then, all of the sets of the punched sheet materials 2 are aligned. Subsequently, the switch 84 is actuated to a second stage position. Here, the lowering or the raising of the lever 16 is not displayed on the display 80. The stopper 12*a* or 12*b* are kept raised.

The aligned set of sheet materials is placed on the supporting tray 9, and the leading edges thereof are abutted to the stopper 12*a* or 12*b*, upon which the stopper 12*a* or 12*b* is lowered. Then, the motor 8 is started, and the ring 6 is opened by the ring opener 7.

By the conveying roller 40*a* driven by the motor 8, the sheet materials are conveyed to a predetermined position where the ring 6 is set. The controller 85 receives a signal indicative of the stoppage of the motor 8, and transmits a signal to the ring opener 7 to close the ring 6. Then, the completion of the operation is displayed on the display 80.

The set of sheet materials 2 now bound by the ring 6 is retracted. Returning the switch 84 to its original state, the automatic sheet material binding apparatus 1 is restored to the automatic mode.

The dividing automatic binding operations are similar to the dividing binding operation of manual mode, but it should be noted that the setting to the ring opening 7 is automatical, so that the manual operation of the binding can be significantly saved.

In the foregoing, the switch 84 is actuated to the first stage, and the grouped sets of sheet materials 2 are sequentially punched and pulled out, and therefore, they are aligned; and thereafter, the switch 84 is actuated to the second stage, so that the aligned sheet materials 2 are conveyed and bound. However, this is not limiting, and the following is a possible alternative. The switch 84 is actuated only by one stage. Then, the sets of grouped sheet materials 2 are sequentially punched. Subsequently, the switch 84 is returned to the original position, by which all of the sets of sheet materials aligned are bound by the automatic mode. More particularly, all of the aligned sheet materials 2 are placed on the supporting tray 9, and the lever 16 is lowered. Since the punched holes are all aligned, the punch 17 penetrates through the already punched holes without resistance, and therefore, the automatic mod operation can be performed. The switch 84 may be such that the automatic mode is selected at the middle switch position, and the other mode or modes can be selected by the side position or positions. Other types are also possible.

According to the third embodiment, the apparatus comprises punching means for punching sheet materials, conveying means for automatically conveying the sheet materials punched by the punching means, binding means for binding the sheet materials conveyed by the conveying means with a binding member, and selecting means for selecting a first mode wherein after the sheet materials are punched by the punching means, they are automatically conveyed to the binding means, and a mode wherein plural sets of sheet materials are separately punched by the punching means, and they are manually aligned. They are automatically conveyed by said conveying means, and they are bound by said binding means.

With this structure, the sheet materials are punched by the punching means, and conveyed by the conveying means to the binding means where the sheet materials are bound with a binding member. The selecting means permits selection between the first mode wherein the sheet materials are punched by the punching means, conveyed by the conveying means to the binding means and bound by the binding means, and a mode wherein the sheet materials are grouped into plural sets of sheet materials which are separately punched by the punching means, and are manually aligned, and then automatically conveyed by the conveying means to the binding means where they are all bound.

According to the third embodiment, as described hereinbefore, the selecting means responsive to switching means permits selection between a mode wherein the sheet materials are punched by the punching means, conveyed by the conveying means to the binding means, and are bound by the binding means, and a mode wherein the sheet materials are grouped into plural sets, and the plural sets are respectively punched, and thereafter, all the sets are manually aligned, and thereafter, all the sheet materials are automatically conveyed to the binding means. Therefore, when a number of sheet materials beyond the punching power of the punching means are to be automatically bound, the sheet materials are grouped into plural sets, and the respective sets are punched, and all the sheet materials are aligned. Thereafter, the sheet materials are automatically conveyed by the conveying means, and the sheet materials are automatically bound. Therefore, the manual operation can be minimized, with the advantage of reduction of the operating time.

The other features in the embodiments described in the foregoing are summarized as follows.

An automatic sheet material binding apparatus comprises punching means for punching sheet materials, binding means for binding the sheet materials with a resin binding member, conveying means for conveying the sheet materials punched by said punching means to said binding means, wherein when the binding means is manually operated with the binding means shifted away from the conveying passage of the sheet material conveying means, a part of an outer housing is rotated in association with movement of the binding means, so that it functions to support the sheet materials. With this feature, when the manual binding operation is performed with the binding means retracted from the sheet material conveyance path, a part of the outer housing is rotated in association with the movement of the binding means to provide a guiding and/or supporting table for the sheet materials during the manual binding operation. Therefore, the manual binding operation is made stabilized and easy.

An automatic sheet material binding apparatus comprises punching means or punching the sheet materials, binding means for binding the sheet materials with a resin binding member, and conveying means for conveying the sheet materials punched by the punching means to the binding means, wherein the binding means is movable away from the conveying means.

With this structure, the automatic sheet material binding apparatus is usable in the automatic mode and the manual mode, because of such a movability of the binding means. Therefore, a thick set of sheet materials or a large number of sheet materials can be added or exchanged irrespective of the punching power of the apparatus. Therefore, the operational efficiency of the sheet material binding can be improved.

One or more of the first, second and third embodiment can be combined.

While the invention has been described with reference to the structures disclosed herein, it is not confined to the details set forth and this application is intended to cover such modifications or changes as may come within the purposes of the improvements or the scope of the following claims.

What is claimed is:

1. A sheet binding apparatus, comprising:

supporting means for supporting a set of sheets;

punching means for punching the sets of sheets on said supporting means;

binding means for binding the sheets by penetrating a ring member through punched holes of the sheets punched by said punching means;

size signal generating means for generating a signal indicative of a size of the ring member supported on said binding means;

means for changing a degree of opening of the ring member in accordance with a size of the ring member;

conveying means for conveying the set of sheets punched by said punching means to the ring member supported on said binding means;

second supporting means for supporting said binding means for movement between an automatic mode position wherein said binding means receives the set of sheets conveyed by said conveying means and a manual mode position wherein the set of sheets can be received without use of said conveying means;

detecting means for detecting the manual mode position of said binding means and for prohibiting conveyance of the sheets by said conveying means;

ring control means for controlling the degree of opening of the ring member during the manual mode;

wherein said ring control means opens the ring member to the degree of opening predetermined in accordance with the size of the ring member.

2. An apparatus according to claim 1, further comprising second detecting means for detecting failure of conveyance of the sheets after the punching, second control means for not operating said punching means and for conveying the sheets to said binding means when the sheet are re-inserted after said second detecting means detects failure of conveyance.

3. An apparatus according to claim 1, further comprising selecting means for allowing selection between a first mode wherein after the sheets are punched by said punching means, the sheets are conveyed to said binding means and a second mode wherein the sheets placed on said first supporting means are conveyed to said binding means without punching operation by said punching means.

4. An apparatus according to claim 3, further comprising third detecting means for detecting that a thickness of the set of sheet materials is beyond punching power of said punching means.

* * * * *

UNITED STATES PATENT AND TRADEMARK OFFICE

CERTIFICATE OF CORRECTION

PATENT NO. : 5,150,998

DATED : September 29, 1992

INVENTOR(S) : KOICHI MURAKAMI ET AL.

It is certified that error appears in the above-identified patent and that said Letters Patent is hereby corrected as shown below:

On the Title page, item [63] RELATED U.S. APPLICATION DATA

Insert, item [63] Related U.S. Application Data
Continuation of Ser. No. 07/506,793,
April 10, 1990, abandoned.--.

item [73] ASSIGNEE

"Daiichi Seiki Kaisha Kabushiki Kaisha," should read
--Daiichi Seiki Kogyo Kabushiki Kaisha,--.

In theDrawings

SHEET 22 OF 23

FIG. 27, "LAVER" should read --LEVER--.

COLUMN 1

Line 62, "the" (first occurrence) shoulb read --thus--.

COLUMN 2

Line 55, "i" should read --in--.

COLUMN 3

Line 41, "shaft" should read --a shaft--.

COLUMN 5

Line 48, "groove 66" should read --grooves 66--.

UNITED STATES PATENT AND TRADEMARK OFFICE

CERTIFICATE OF CORRECTION

PATENT NO. : 5,150,998

DATED : September 29, 1992

INVENTOR(S) : KOICHI MURAKAMI ET AL.

It is certified that error appears in the above-identified patent and that said Letters Patent is hereby corrected as shown below:

COLUMN 8

Line 58, "stoppers" should read --stopper--.

COLUMN 9

Line 66, "b" should read --be--.

COLUMN 11

Line 19, "is" should read --are--.

COLUMN 13

Line 39, "the" (second occurrence) should read --he--.
Line 48, "material" should read --materials--.

COLUMN 15

Line 27, "are" should read --is--.
Line 48, "automatical," should read --automatic,--.
Line 66, "mod" should read --mode--.

UNITED STATES PATENT AND TRADEMARK OFFICE

CERTIFICATE OF CORRECTION

PATENT NO. : 5,150,998

DATED : September 29, 1992

INVENTOR(S) : KOICHI MURAKAMI ET AL.

It is certified that error appears in the above-identified patent and that said Letters Patent is hereby corrected as shown below:

COLUMN 18

Line 25, "sheet" should read --sheets--.

Signed and Sealed this

Fifteenth Day of June, 1993

*Attest:*

Michael K. Kirk

MICHAEL K. KIRK

*Attesting Officer*

*Acting Commissioner of Patents and Trademarks*